US008777066B2

(12) United States Patent
Esteve et al.

(10) Patent No.: US 8,777,066 B2
(45) Date of Patent: Jul. 15, 2014

(54) PACKAGING ELEMENT WITH A HERMETICALLY SEALED DOSING MECHANISM FOR SEMI-SOLID PRODUCTS

(76) Inventors: Victor Esteve, São Paulo (BR); Eric Zembrod, Boituva (BR)

( * ) Notice: Subject to any disclaimer, the term of this patent is extended or adjusted under 35 U.S.C. 154(b) by 122 days.

(21) Appl. No.: 13/322,767

(22) PCT Filed: Dec. 23, 2009

(86) PCT No.: PCT/BR2009/000435
§ 371 (c)(1),
(2), (4) Date: Nov. 28, 2011

(87) PCT Pub. No.: WO2010/081210
PCT Pub. Date: Jul. 22, 2010

(65) Prior Publication Data

US 2012/0097712 A1 Apr. 26, 2012

(30) Foreign Application Priority Data

Jan. 15, 2009 (WO) ..... PCT/BR2009/000008

(51) Int. Cl.
*B67D 7/60* (2010.01)

(52) U.S. Cl.
USPC ..... 222/390; 222/386; 222/405; 401/68; 401/172; 401/175

(58) Field of Classification Search
USPC ..... 222/405, 386, 390; 401/68–69, 401/172–175
See application file for complete search history.

(56) References Cited

U.S. PATENT DOCUMENTS 1,936,822 A * 11/1933 Boenecke ..... 222/320
3,241,729 A * 3/1966 Gabler ..... 222/390

(Continued)

FOREIGN PATENT DOCUMENTS

DE 3936449 5/1991
DE 202005003825 7/2006

(Continued)

OTHER PUBLICATIONS

International Search Report for PCT/BR2009/000435.

(Continued)

*Primary Examiner* — Frederick C Nicolas
(74) *Attorney, Agent, or Firm* — B. Aaron Schulman, Esq.; Stites & Harbison, PLLC.

(57) ABSTRACT

Packaging element with a hermetically sealed dosing mechanism for semi-solid products, comprehending its body as a sole piece (10) injected in plastic material, configuring two concentric parts, one internal that configures the product containing cup-like recipient (11) and an external which configures a skirt for optional finishing (12), both with their top endings integrated between themselves by a horizontal wall (13), above which emerge vertically two concentric collars (14) and (15), which configure a hermetical coupling for a device in the shape of a spinning disc (16) that rotates in only one direction and always in the same plane in relation to the main body (10), and whose spinning disc (16) outside portion, may receive an optional over-lid (17), while from its inside portion has constructive details integrated to the assembly of an integrated protection dosing valve mechanism (18) and an actioning mechanism (19) for a piston (20) that, by its turn, initially (full package) is placed along with the bottom (21) of the cup-like recipient (11) containing the product (P).

11 Claims, 36 Drawing Sheets

(56) References Cited

U.S. PATENT DOCUMENTS

| | | | | |
|---|---|---|---|---|
| 4,946,076 | A * | 8/1990 | Hackmann et al. | 222/207 |
| 5,062,592 | A * | 11/1991 | Kishimoto | 244/164 |
| 5,484,087 | A | 1/1996 | Negrych | |
| 5,725,133 | A | 3/1998 | Iaia | |
| 6,039,483 | A * | 3/2000 | Szekely | 401/50 |
| 6,688,793 | B2 | 2/2004 | Goyet | |
| 6,923,349 | B2 * | 8/2005 | Lou | 222/521 |
| 7,228,941 | B2 * | 6/2007 | Weigand et al. | 184/7.4 |
| 7,300,221 | B2 * | 11/2007 | Byun | 401/286 |
| 7,303,348 | B2 * | 12/2007 | Phipps et al. | 401/175 |
| 7,314,327 | B2 * | 1/2008 | Byun | 401/265 |
| 7,325,707 | B2 * | 2/2008 | Bougamont et al. | 222/390 |
| 7,654,420 | B2 * | 2/2010 | Honda et al. | 222/386 |
| 2007/0086833 | A1 * | 4/2007 | Gurrisi | 401/266 |
| 2011/0297704 | A1 * | 12/2011 | Esteve et al. | 222/390 |

FOREIGN PATENT DOCUMENTS

| | | |
|---|---|---|
| EP | 0580512 | 1/1994 |
| FR | 2681767 | 4/1993 |
| FR | 2876257 | 4/2006 |

OTHER PUBLICATIONS

Written Opinion of the International Searching Authority for PCT/BR2009/000435.

International Preliminary Report on Patentability for PCT/BR2009/000435.

* cited by examiner

PACKAGING ELEMENT WITH A HERMETICALLY SEALED DOSING MECHANISM FOR SEMI-SOLID PRODUCTS

FIELD OF THE INVENTION

The invention herein, more particularly refers to a packaging element with a cup-like recipient for containing different semi-solid products (from low to high viscosity), such as, for example, some kinds of pharmaceuticals, cosmetics or chemicals which, in general are presented in the form of creams, pastes or gels.

BACKGROUND OF THE INVENTION

Currently there are different packing elements for similar use, such as those taught in the documents: DE 3936449, DE 202005003825, EP 0580512, EP 0787445, FR 2681767, FR 2816813 and FR 2876257. Doubtless such packing elements grant means for containing different cosmetic and pharmaceutical products, nevertheless they do not present an hermetically sealed (tight) functioning concept, therefore the hermetic condition obtained for such sets are limited only to the retention of the product not avoiding the external air inlet and direct contact of the product with the external environment during the dispensing process, consequently the product must have a quantity of preserving agents and other chemical substances to avoid its oxidation and degradation during its life time and use.

SUMMARY OF THE INVENTION

The present invention seeks to provide a packaging with a hermetically sealed dosing mechanism for semi-solid products.

DETAILED DESCRIPTION OF THE INVENTION

State of the Technique

Figure 1:
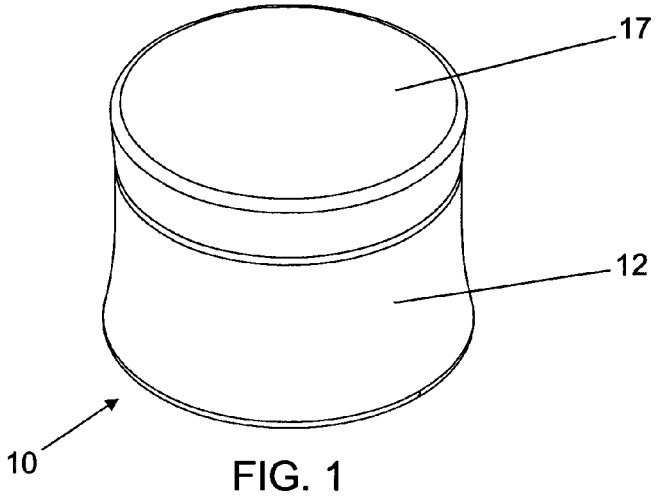
FIG. 1—Shows a perspective from a superior angle.
Figure 2:
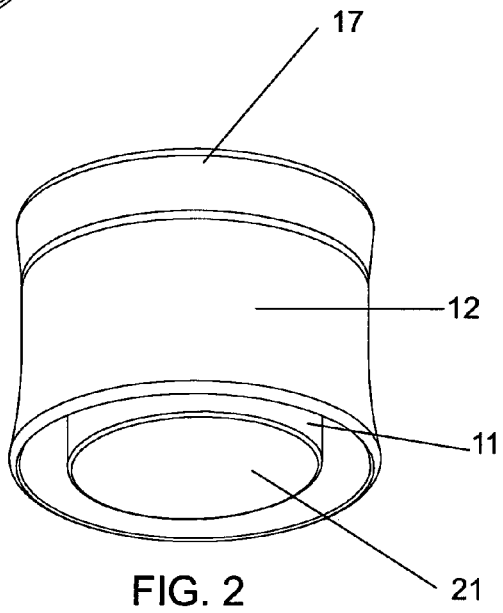
FIG. 2—Shows another perspective, although from an inferior angle.
Figure 3:
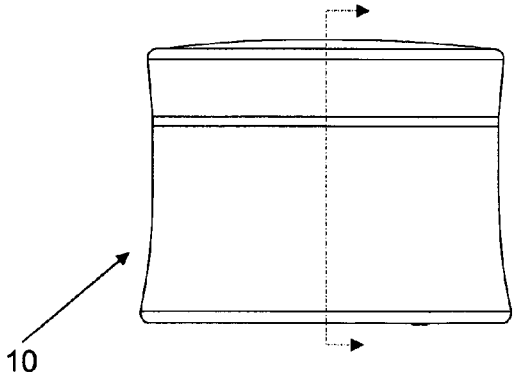
FIG. 3—Shows a lateral view.
Figure 4:
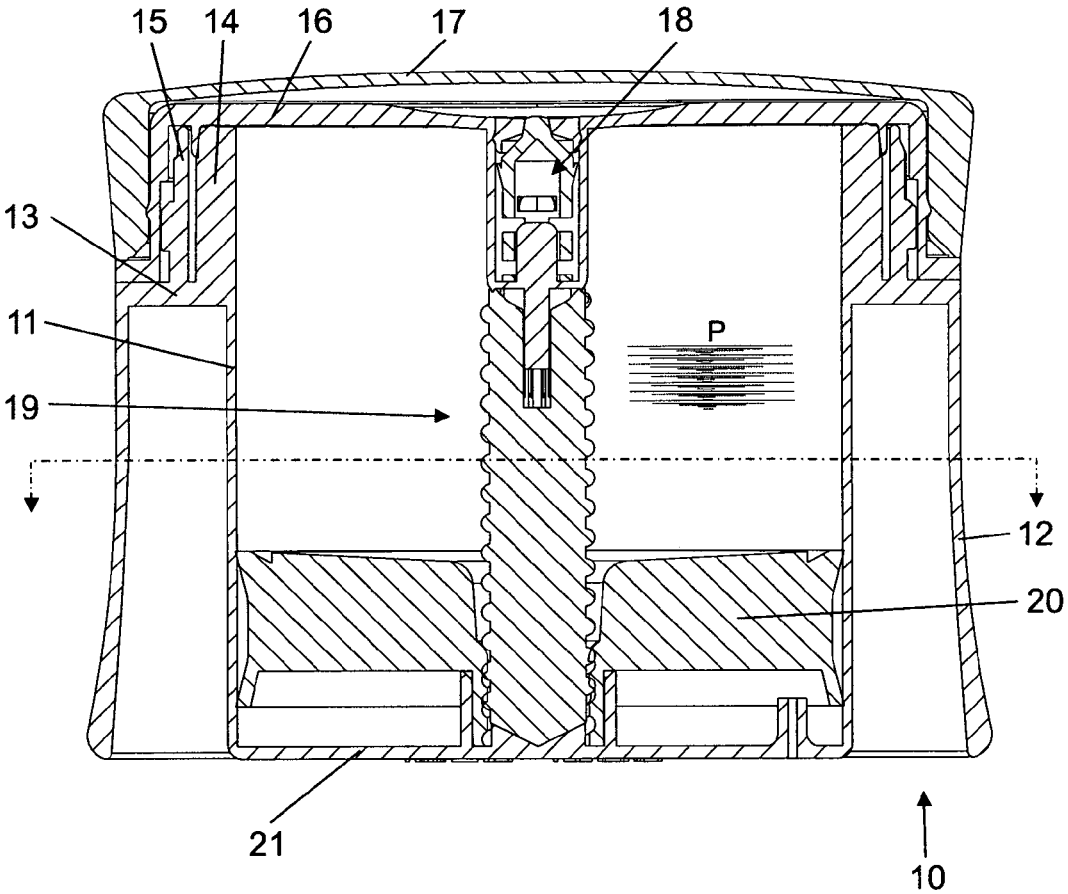
FIG. 4—Show a view in transversal cut and a top view also in cut, above the line indicated in the previous figure.
Figure 4:
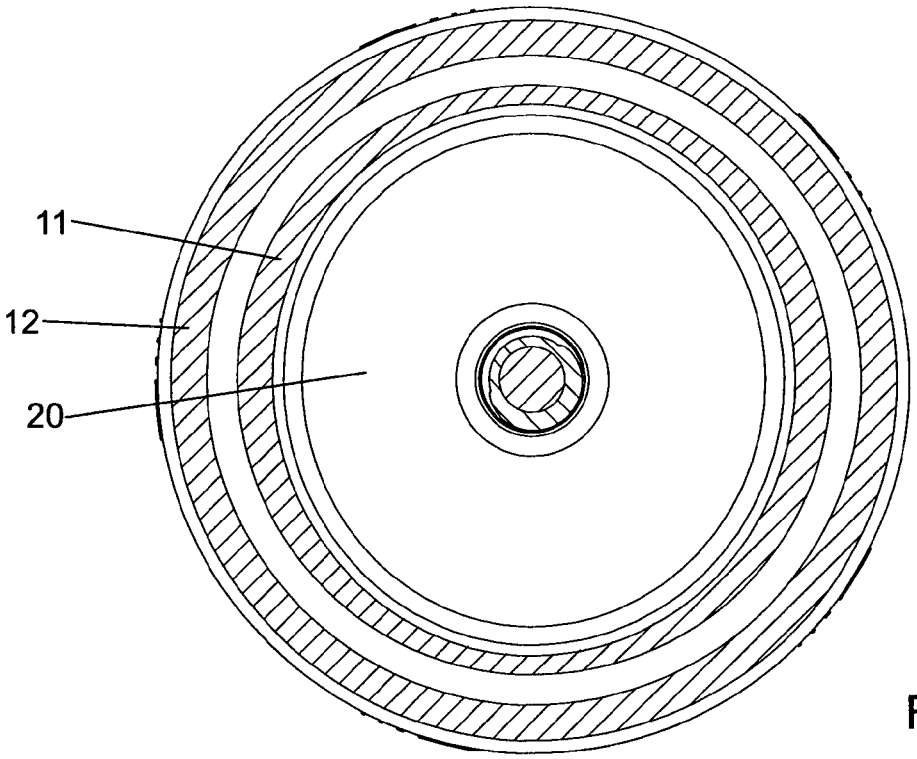
Figure 5:
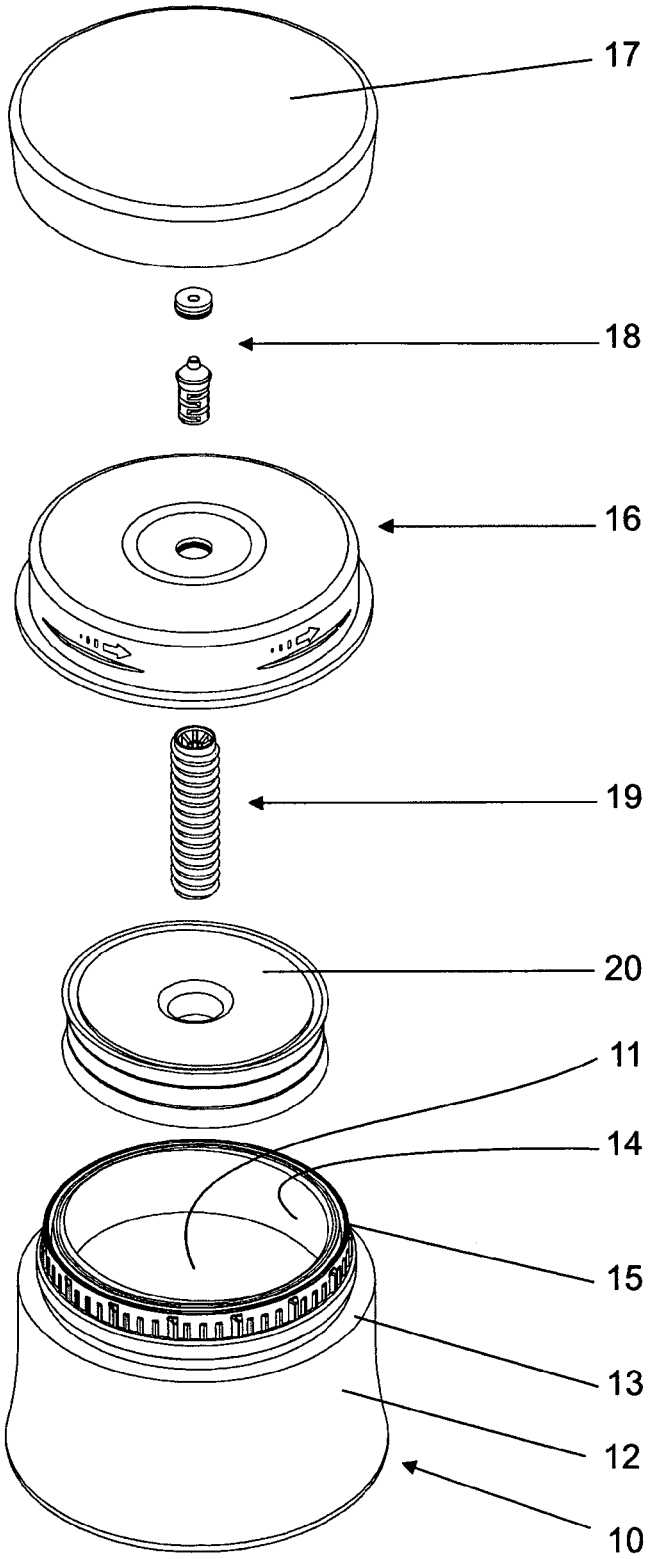
FIG. 5—Exhibits an exploded perspective from a superior angle.
Figure 6:
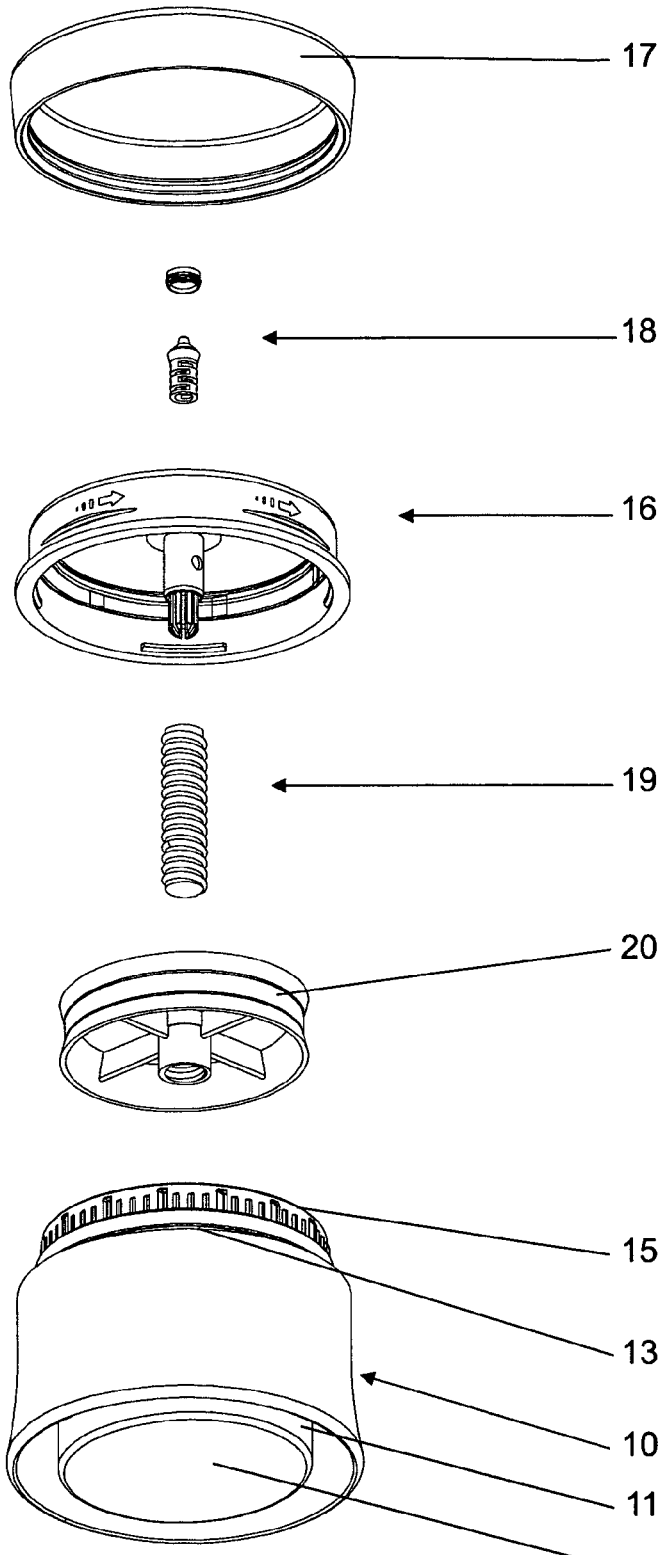
FIG. 6—Reproduces another exploded perspective, although, from a inferior angle.

Objects of the Invention The first objective of the present application is an hermetic packing element with a precise dosing system and with a cup-like recipient compartment to contain various forms of semi-solid products (of high and low viscosity), traditionally known as creams, pastes or gels. Examples of such products are some cosmetics and pharmaceutical products or other chemical formulations which requires precise dosing application and adequate storage to secure an indication of use and to maintain the product's stability during life-time (shelf-life time) and during use. Another objective of the invention is to combine a cup-like recipient hermetic sealed, associated with an actioning system functioning by mechanical pressure, avoiding inlet of air into the system at any condition, keeping the system hermetically sealed (tight) on and off-use.

Such characteristics are necessary to protect the product to be dosed against oxidation or contamination exposure during storage time and use.

The hermetic concept of such container has also the objective to allow reduction of preserving agents in cosmetic or pharmaceutical formulations, since there is no direct contact of the contents with the exterior environment, ensuring an efficient way for storing and using the product. Such hermetic concept has also the objective of making it possible to extend the lifetime of products with less quantity of preserving agents, or which active ingredients and excipients are volatile or sensitive to oxygen.

The packing system is preferably manufactured with plastic resins compatible among themselves to allow total recycling of the packing set after its use.

Still, such packaging concept enables the handling of the set in a more practical and economic way for the filling of its content (product) at any production scale and to permit several external variations of design, and also allow the final consumer to have maximum efficiency for the use of its contents, leaving a minimum residual volume inside the system when empty.

In the invention, the packing system hermetic sealing is ensured by a set of components which conforms in a single body, not dependable of a protecting lid (over-placed to the system) to ensure a perfect hermetic sealing of its inner portion.

The sealing is ensured in four critical points perfectly designed to offer the necessary hermetic sealing parameters, with preferably one or more sealing connections (protection barriers) in each critical point in order to avoid inlet of external air into the system and direct contact of the product with the external environment when the mechanism is on or off use and during product dose release.

In one variation of the present invention a cup-like recipient is used in a refill version, not with the objective of reducing preserving agents in the product (formulation), but as a safe mean for storing and dosing semi-solid products with significant reduction of the package environmental impact.

The refill mode has the further objective to make the packaging system comply with the current ecological criteria for granting it the label "ecological friendly" with reduction of the environmental impact according to criteria of RPT (Ratio/Product/Tare), number of times that the package is reused and correct use of dosages (without waste), according with Annex 9 of the European Community Decision Commission from Brussels, published in the Official European Union Journal in Jun. 26, 2007, notified with number C(2007)3127.

The cup-like recipient, containing the product, includes a piston connected to a dosing mechanism formed by a screw rod attached to a spinning disc, this last being responsible for the hermetic sealing of the cup-like recipient.

The hermetic dosing device is also integrated by an optional over-lid.

The spinning disc is designed to rotate always in the same plane in relation to the main body to keep the hermetic sealing, and, at the same time, rotates the screw element, activating in such a way the upward displacement of the piston, which applies pressure on the product located in the inner portion of the cup-like recipient, forcing it into a dosing chamber and, through a control valve system (obturator), that when in rendered active, releases a dose of the product over an existing depression on the top center part of said spinning disk, from where it is removed manually.

The protective valve system (described in this patent as an "obturator") located at the outlet of the cup-like recipient is overcome by the product only after a determined pressure is applied, and at this moment, a certain amount of product flows through the same, and through the outlet nozzle, placing itself on a depression at the center of the spinning disc.

The release of the product (complete dose output) occurs up to the extent were the internal pressure is reduced to a point where the valve system is tightly sealed again.

Therefore, during the actioning of the dosing mechanism, no external air inlet is allowed inside the system and, therefore direct contact of the product with the external air is also avoided, characterizing a hermetically (tight) sealed way of dispensing.

Through a carriage system, the spinning disc, along with the cup-like recipient, allows the release of controlled doses and, at the same time, prevents the backward rotation of such disc.

DETAILED DESCRIPTION OF THE INVENTION

As it can be seen in FIGS. 1 to 6, a body as a sole piece (10) injected in plastic material, configuring two concentric parts, one internal that configures the product containing cup-like recipient (11) and an external which configures a skirt for optional finishing (12), both with their top endings integrated between themselves by a horizontal wall (13), above which emerge vertically two concentric collars (14) and (15), which configure a hermetical coupling for a device in the shape of a spinning disc (16) that rotates in only one direction and always in the same plane in relation to the main body (10), and whose spinning disc (16) outside portion, may receive an optional over-lid (17), while from its inside portion has constructive details integrated to the assembly of an integrated protection dosing valve mechanism (18) and an actioning mechanism (19) for a piston (20) that, by its turn, initially (full package) is placed along with the bottom (21) of the cup-like recipient (11) containing the product (P), where said piston spinning is avoided by the fact that the internal diameter of the cup-like recipient (11) (FIG. 4) is slightly oval, although, said piston (20) is operatively assembled to be displaced only upwards upon activating the spinning disc (16) and, along with, the mechanism (19), in a way that the said piston may apply enough pressure to the product (P) placed above it, to open the dosing valve (18) and allow exact dosages of the product to be dispensed above the said spinning disc (16) on to a surface (39) where it can be removed with the fingers for application.

Figure 7:
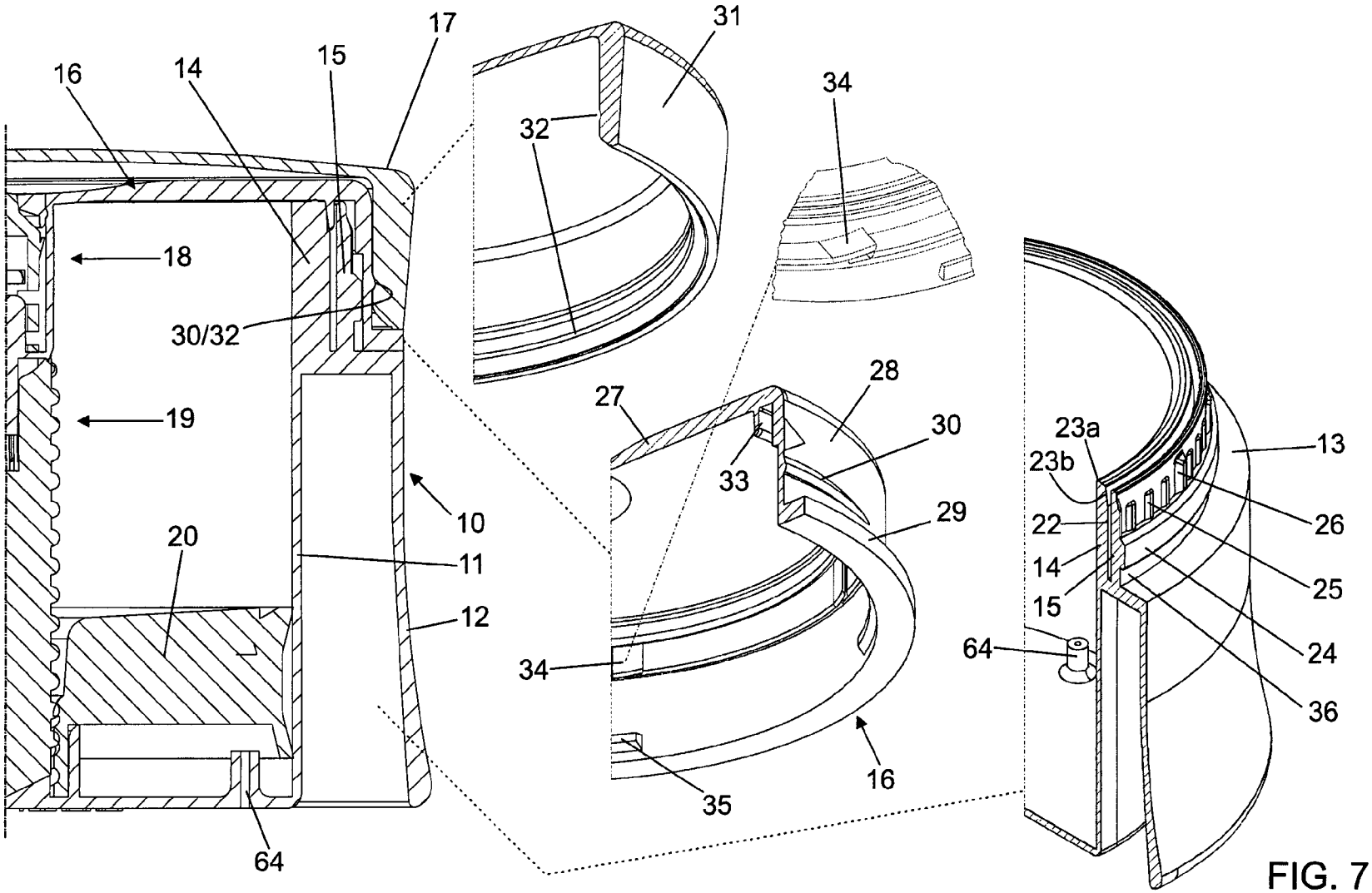
FIG. 7—Is a partial view, in transversal cut, and various details magnified in perspective.
Figure 8:
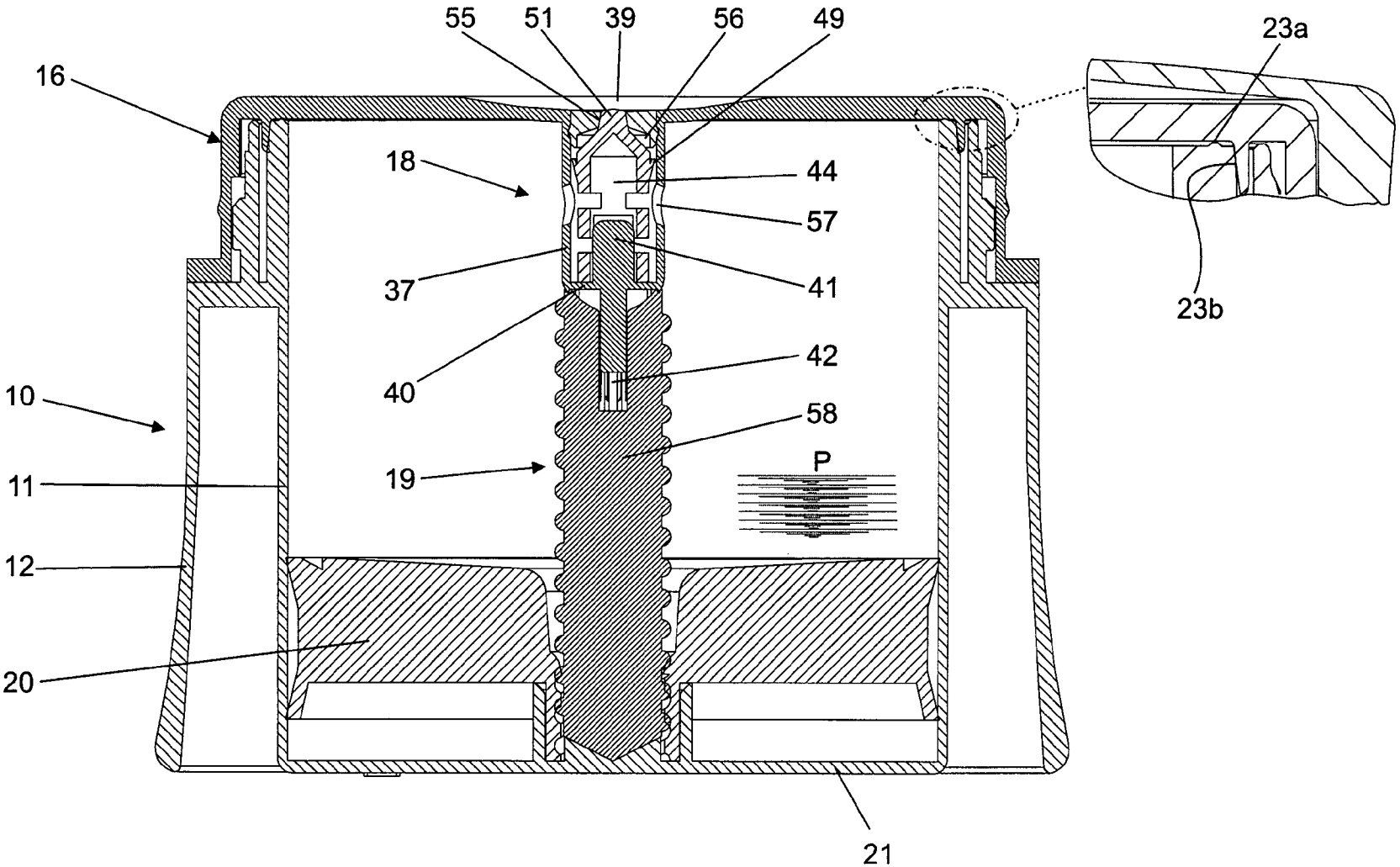
FIG. 8—Shows another side view in cut and one respective detail magnified.
Figure 10:
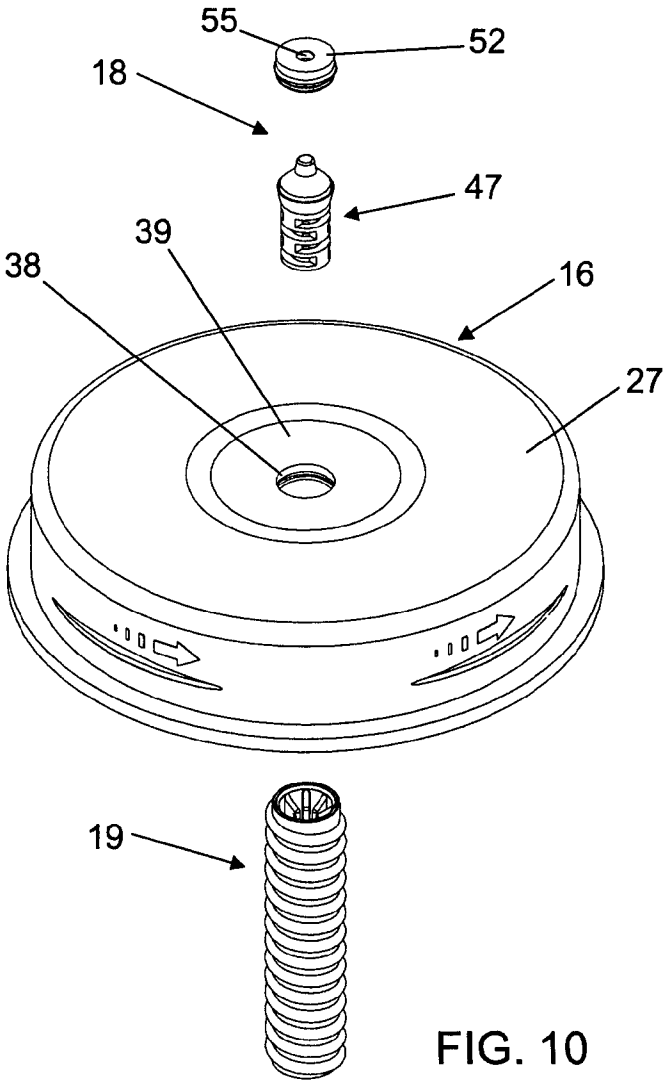
FIG. 10—Shows a partial view, in exploded magnified perspective, with details from the protection dosing valve set and spinning disc.
Figure 9:
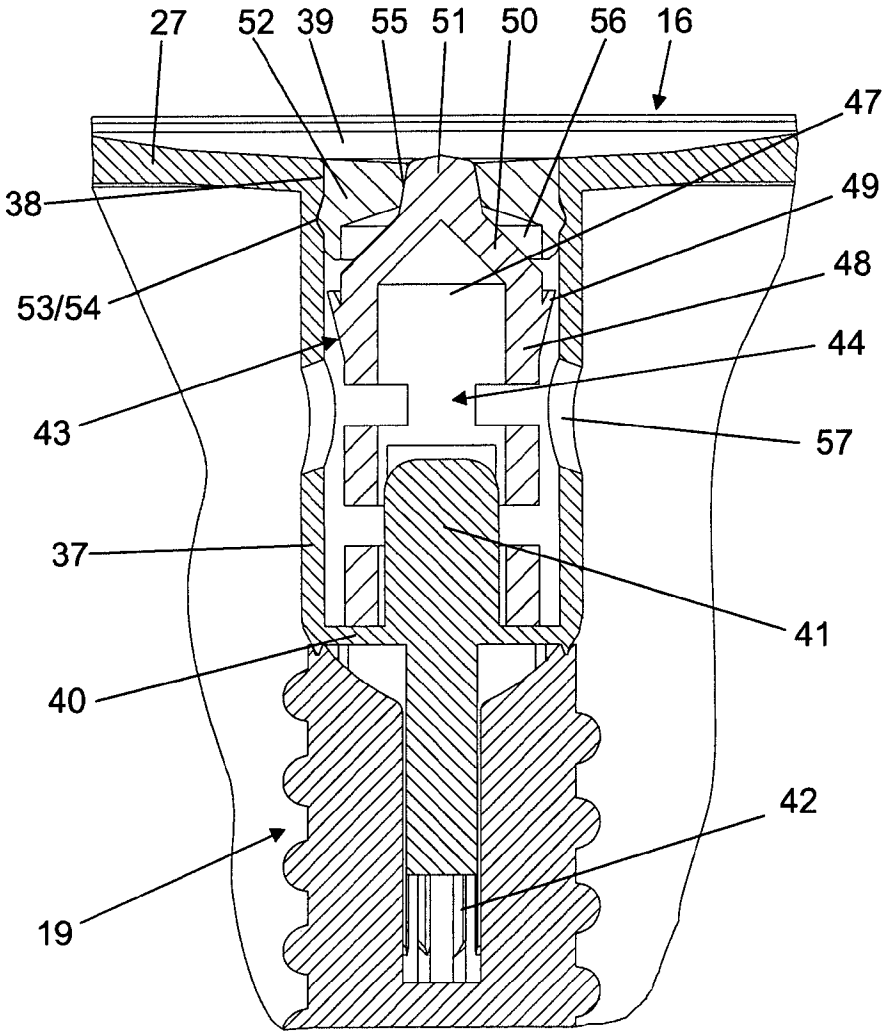
FIG. 9—Represents a magnified detail from the view in cut of FIG. 8.
Figure 11:
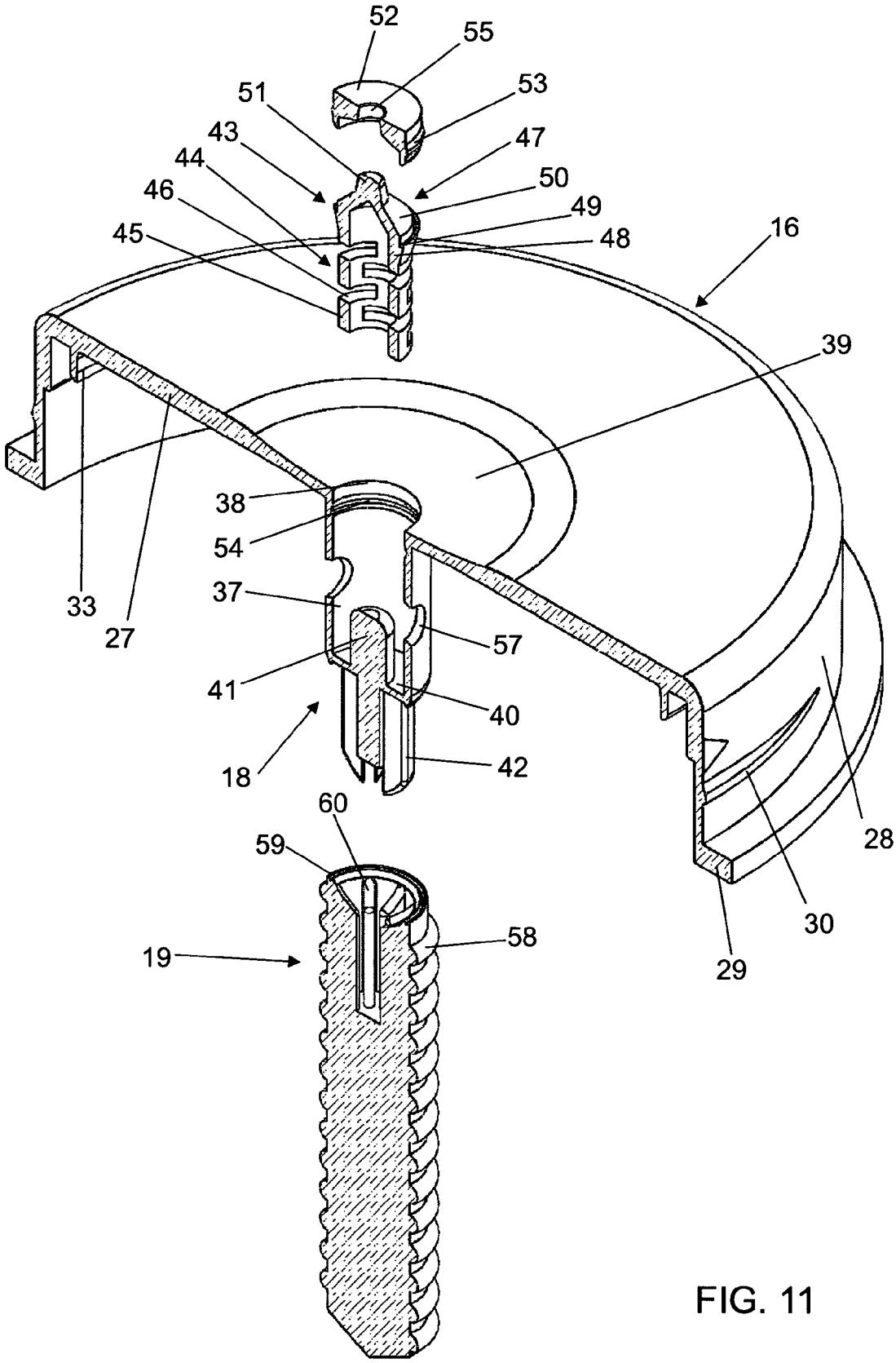
FIG. 11—Represents a partial perspective view from a superior angle, showing in an exploded form, the details of the spinning disc actioning set.

As it can be seen in FIGS. 7 and 8, the two collars (14-15) present means for a hermetic coupling of the spinning disc (16) and means for the spinning disc to rotate always in the same plane in relation to the body (10) and only in one sense, preferably anti-clockwise. For that, initially the two collars (14-15) are enough concentrically apart one to the other to form a void (22), where the top edge of the internal collar (14) presents details of a circular closing ring in the shape of a top nervure (23*a*) and a cut (23*b*) placed in ramp towards the interior of the void (22), while the other external collar (15) presents in its external diameter two details in which the first one is a circular ring protrude (24), like a flange, above which there is a collar of smaller equidistant teeth (25) spaced apart in groups by other similar larger teeth (26), configuring a rotational turnstile control for advance of the spinning disc (16), that is turned, by the horizontal superior wall (27) an the a vertical cylindrical skirt (28), this last, having its bottom edge projected outwards in the shape of a flange (29) with diameter to lay on that portion of the wall (13), and, still, on the diameter of the said spinning disc (16) there are smooth locking fillets (30) for the seating of an optional over-lid (17) which, by the internal side of its skirt (31) it has a continuous smooth coupling groove (32) to seat on said filets (30) of the spinning disk (16) which, still, has two details for hermetic closing, in which, the first is a concentric cylindrical lip of reduced height practically in the shape of a circular guide, or track (33), which diameter is something to penetrate with interference in the void (22) and to be tensioned over the cut (23*b*), while at the second point of hermetic closing the bottom surface of the spinning disc (16) makes a certain pressure on the circular closing ring or top nervure (23*a*) located on the upper part of the collar (14), allowing an hermetic coupling for its closure type spinning disc.

The spinning disc (16) presents other internal details constituted by a collar of flexible equidistant tabs (34), slightly bent and oriented to slide on a carriage formed by the teeth (25) and (26) such sliding occurs in only one direction, since in the contrary sense, the edge of the tabs have the teeth (25-26) as barriers, being that, still in the internal portion of the spinning disc (16) includes a collar of coupling projections (35) with a trapezoidal transversal section dimensioned and oriented to be inserted in the groove (36) formed between the ring salience (35) and that wall (13), establishing, in this way a sliding coupling for the spinning disc (16), in a way that it is kept permanently over pressured against the body (12), as well as being turned in only one direction, and always in the same plane in relation to the body (12) to secure its sealing.

The interference between the coupling projections (35) of the spinning disc (16) and the ring salience (24) of the body (12) determines the sealing pressure over the sealing ring or to nervure (23*a*) against the inferior face of the spinning disc (16) and the lip tensioning (33) at the wall of the groove (22), characterizing, is such a way, the necessary sealing during the disc spinning (16).

The dosage protection valve mechanism (18) details are illustrated in the FIGS. 8 to 11, through which it is possible to verify that it presents a tubular dosing chamber (37), which top end is completely opened and is integrated with the wall (27) of the spinning disc (16), configuring an opening (38) whose top portion is circumscribed by a recess ordinarily shaped in form of a shell (39) for accumulation of the product's (P) dose, while through the bottom end, the tubular dosing chamber (37) is completely sealed by a wall (40), which is centrally crossed by an integrated projection defined by two edges, one internal cylindrical on the top (41) and one external finned with first fins (42) on the bottom, this last one constitutes a coupling for the actioning mechanism (19) and the piston (20) while the other (41) constitutes a coupling point for stabilizing an obturator (43) which is formed in one sole piece defined by two parts, a bottom portion with a spring-like function (44) formed by a section ordinarily tubular (45) with several cuts (46) and a superior part defined as a sealing lid (47), having a section ordinarily cylindrical (48) which constitutes the top end of said spring (44), such cylindrical section has a collapsible sealing lip (49) which slides with interference (or tension) at the internal diameter of the dosing chamber (37), and above said sealing lip (49), the cylindrical section (48) has an accentuated narrowing with a conic-shape (50) which ends in a point equally conic (51), which is oriented to penetrate in a sealing insert (52), this last with its external diameter endowed with a circular locking fillet (53) which penetrates in a groove equally circular (54) existing in the dosing chamber internal diameter (37) and along with an opening (38) where said insert is firmly locked, as well as, equipped with a conic central nozzle (55) for the product outlet, although, normally closed by the tip of the sealing lid (51) permanently pressed upwards by the spring-like part (44), although such closing occurs in a way that between the sealing (49) and the lid (47), as well as above the sealing lip (49) forms an access area (56) for the product (P) which arrives to the inner part of the valve (18) through one or more radial passages (57) existing at the wall of the dosing chamber (37), where the pressure of the product (P) overcomes the spring pressure (44) and makes the sealing tip (51) to be temporarily displaced downwards releasing the nozzle (55) enough for one dose of the product (P) to be deposited on the recess (39), returning to close the outlet orifice nozzle (55) immediately after the internal pressure is compensated through the dosage release.

Figure 12:
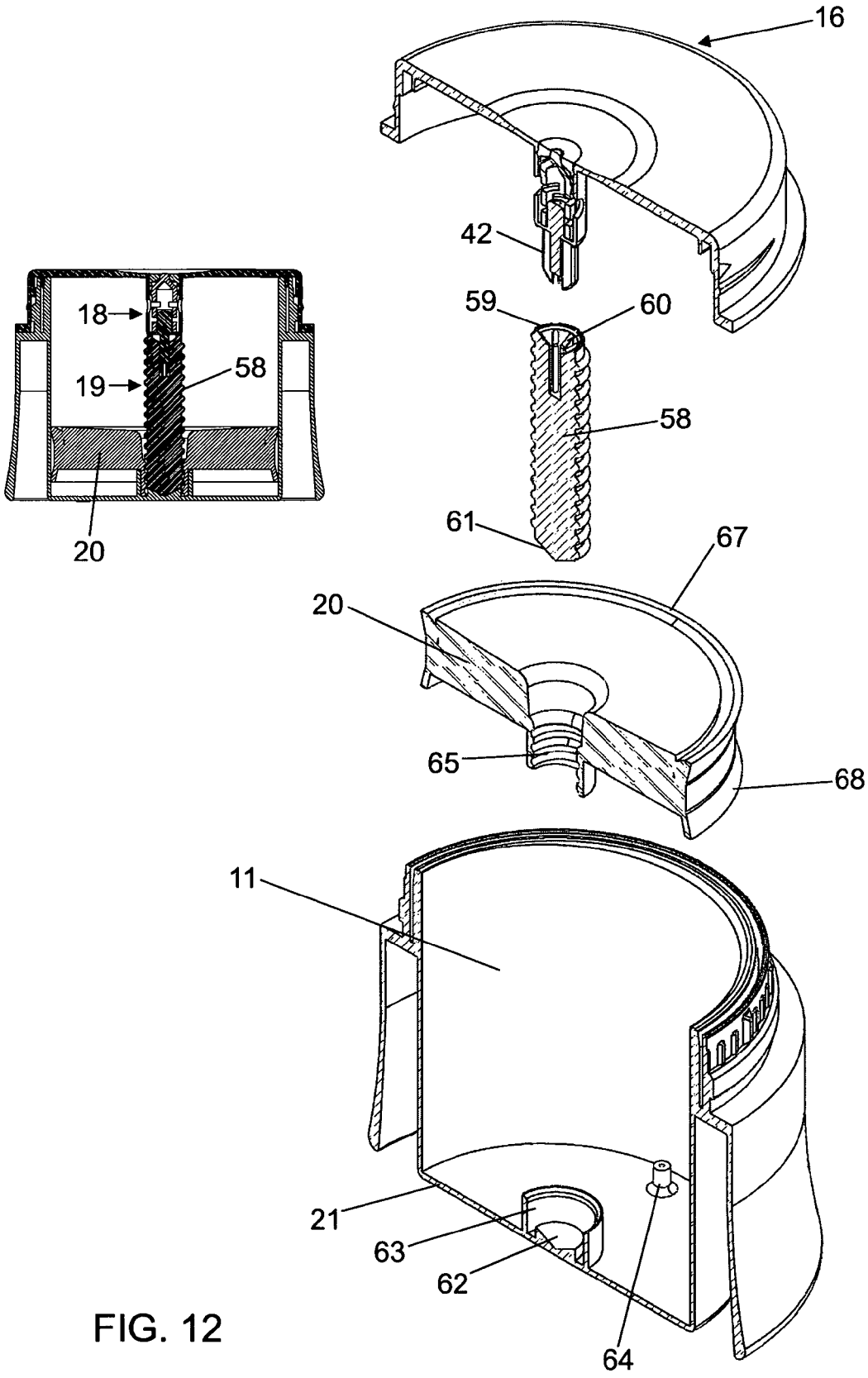
FIG. 12—Is a view of the assembled set an in cut, and also a perspective view in cut from a superior angle, in exploded way, of the actioning set with details of piston and cup-like recipient.
Figure 13:
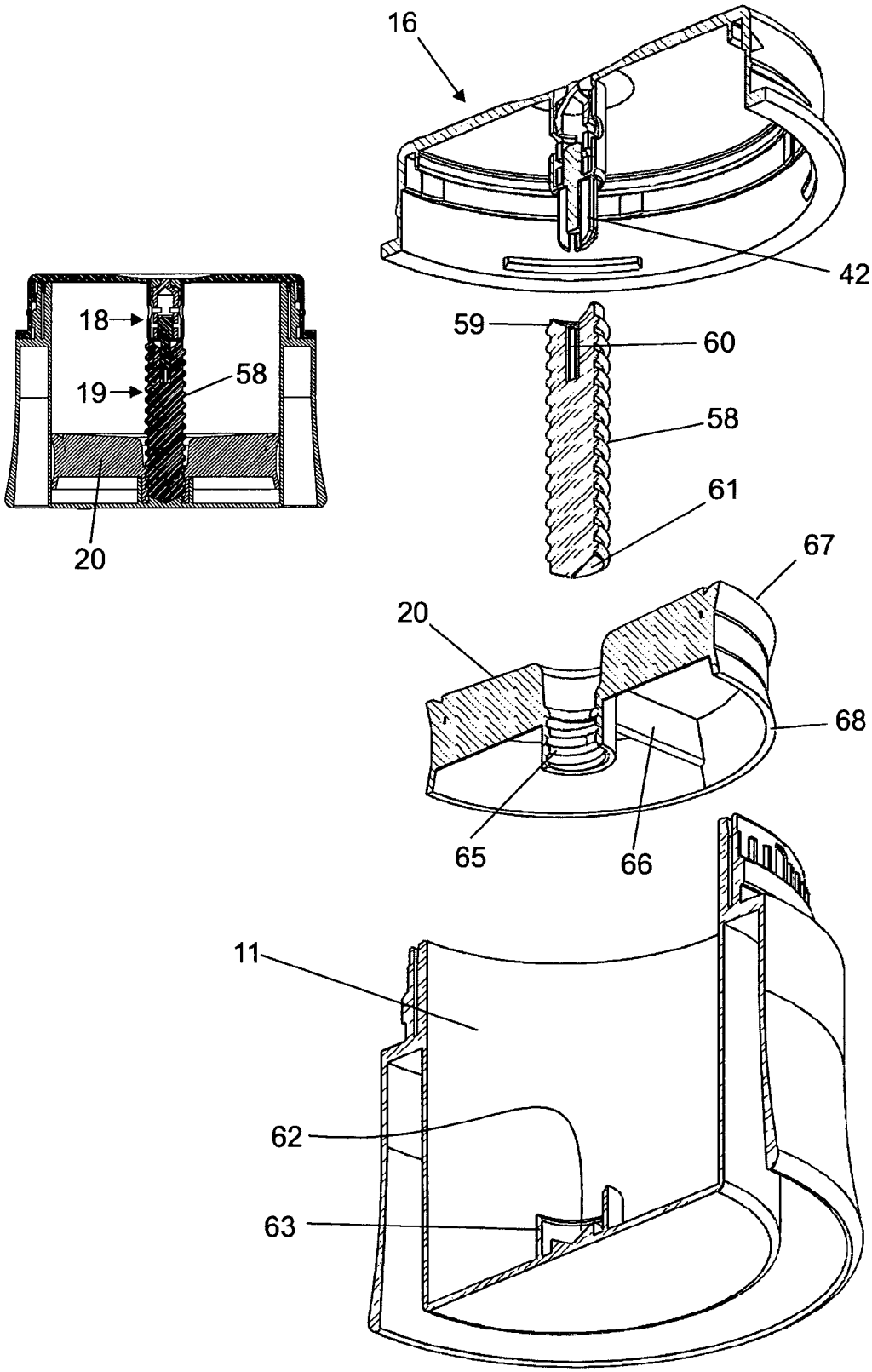
FIG. 13—Shows a similar exploded perspective and in cut as in FIG. 12, although from an inferior angle.

The activating mechanism (19) is illustrated in details in FIGS. 12 and 13, where it can be verified that the activating mechanism (19) is formed by a screwed-rod (58), which presents on its top part a short tubular section (59) having in its inner portion radial fins (60) in between which those first fins (42) located in the under center part of the spinning disc (16) penetrates, in a way that both screw-rod (58) and spinning disc (16) may be solitarily bonded while the bottom end of the said screwed-rod (58) has a conic shape (61) to lay over an equally centered projection with its top part shaped also in a conic manner (62), which is circumscribed by a short tubular portion (63) which emerges from the internal bottom wall (21) in the internal part (11) of the cup-like recipient where there is a anti-vacuum opening (64), being that, as already explained, next to the said bottom, the piston (20) is positioned, having it a central hole with an internal screw (65) elongated downwards to be coupled between the seat (62) and the wall (63) from where said piston (20) begins its upwards displacement and also, on its bottom portion radial bars (66) are placed for a balance structuring of its external diameter, where top and bottom edges form sealing lips (67-68) which remain permanently pressured against the internal diameter of the cup-like recipient (11) to ensure the hermetic sealing in this point.

Once the screwed-rod (58) is positioned with some interference inside the internal screw (65) of the piston, the hermetic sealing of the system in this point is ensured with at least one complete turn of the screw (pace) while the system (package) is not activated (self-life), and with at least one or more complete turns of the screw (pace) when the system is once activated.

In this constructive configuration, the hermetic sealing is also ensured at this point by the fact that the filet of the screw-rod (58) is perfectly equal to the screw pace (65) in the center of piston (20).

The functioning of the package, as described, is really very simple, since as it has already been said (FIGS. 7 and 8), the spinning disc (16) is developed to suffer successive displacements in one sole sense/direction, as if an engine movement (pace), being that each rotational advance movement (pace) generates a dose, the rotation movement (pace) is sensed by the user at each displacement over the main teeth (26) being that the smaller intermediate teeth (25) are responsible for not allowing the disc (16) to rotate in the contrary direction between dosages.

The volume (grams) of the released (dosage), at each rotation over each teeth (26), can be determined by the screw turn (pace) (58/65) and by the area of product (P) contained above the piston (20).

In this manner, to withdraw one dose, the user must apply a displacement (pace) at the spinning disc (16), and as a consequence, the turn is applied to the piston (20) through the screwed-rod (58), making said piston to be displaced upwards.

Although this movement is reduced, it is enough to create pressure in the inner part of the cup-like recipient (11) or pressure over the product (P), which has only as escape point the hole or holes (57) placed at the dosage chamber (37). The product invades the inner portion of the valve (18) and pressures the point of sealing in shape of a lip (49), which profile is projected to give in when this pressure exists, allowing the product to flow into the interior of the access area (56).

At this stage, the product (P) that already flowed into the dosing chamber (37) applying pressure on the obturator (43), passing the sealing lip (49), forces it downwards against its spring-like portion (44) due to its elasticity, and since the spring-like part is placed in the opposite part from of the obturator tip (51) it consequently recedes momentarily from the outlet nozzle (55) so that the product (P) dose may get out and be deposited at that cavity (39), where it is manually removed by the user.

The product flow occurs while the internal pressure generated by the advance of the piston (20) is superior to the strength of the spring (44) because, on the contrary situation, said spring (44) forces the tip (51) of the obturator (43) immediately to close the outlet nozzle (55), at the same time, the sealing lip (49) also returns to its original position with tension against the internal diameter of the tubular dosing chamber (37) of the valve (18), finalizing, in such a way, a hermetic dosage dispensing system without back-stream of product or residual product left on the nozzle, and also as noticed to be impossible to occur inlet of external air in the system during actioning, when being used, and off-work.

The anti-vacuum opening (64) exists only to avoid generation of vacuum bellow the piston (20), what would impair its displacement upwards in the inner portion of the cup-like recipient.

Figure 14:
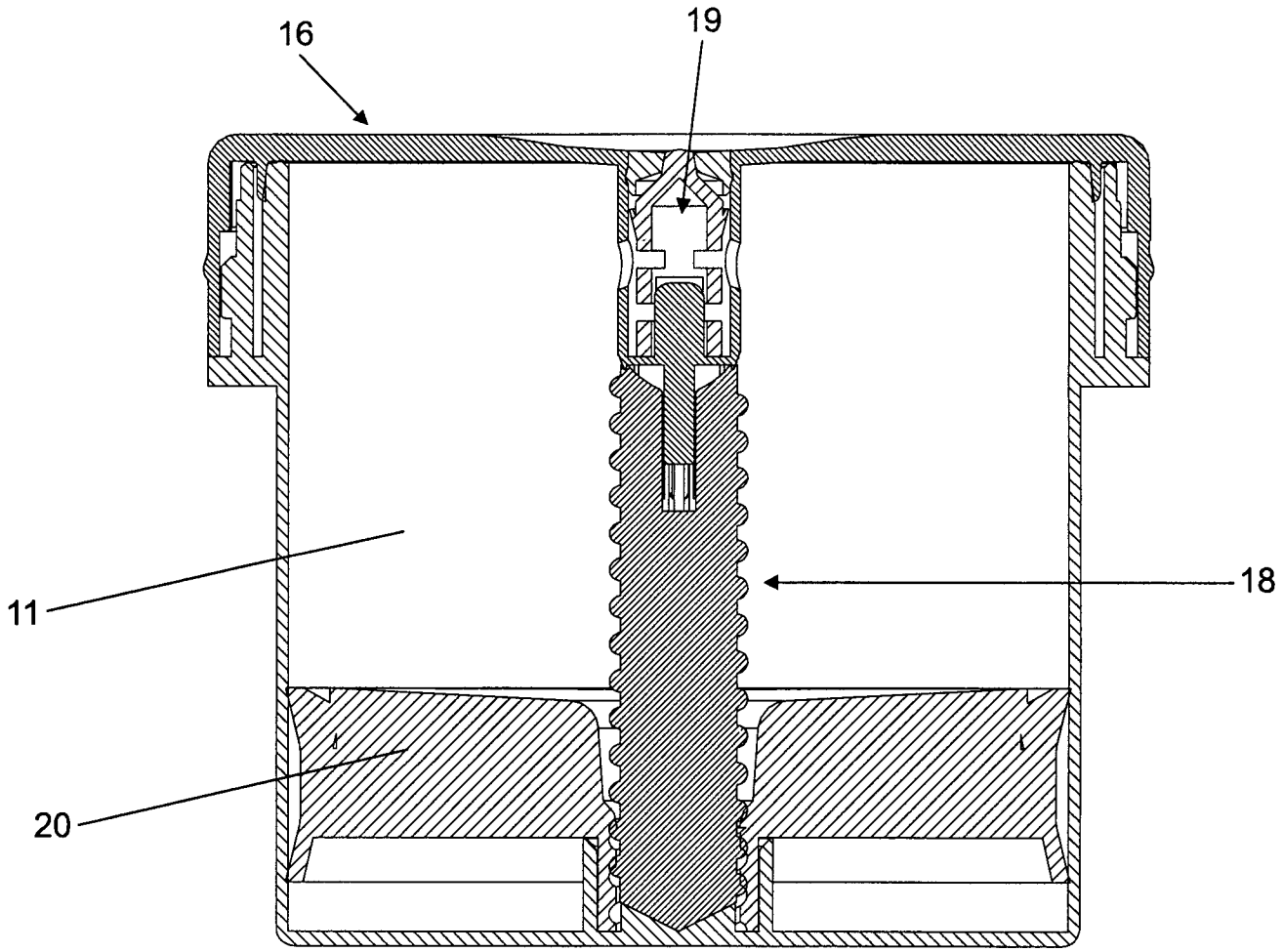
FIG. 14—Shows a side view in cut of another constructive option for the top portion of the package system.
Figure 15:
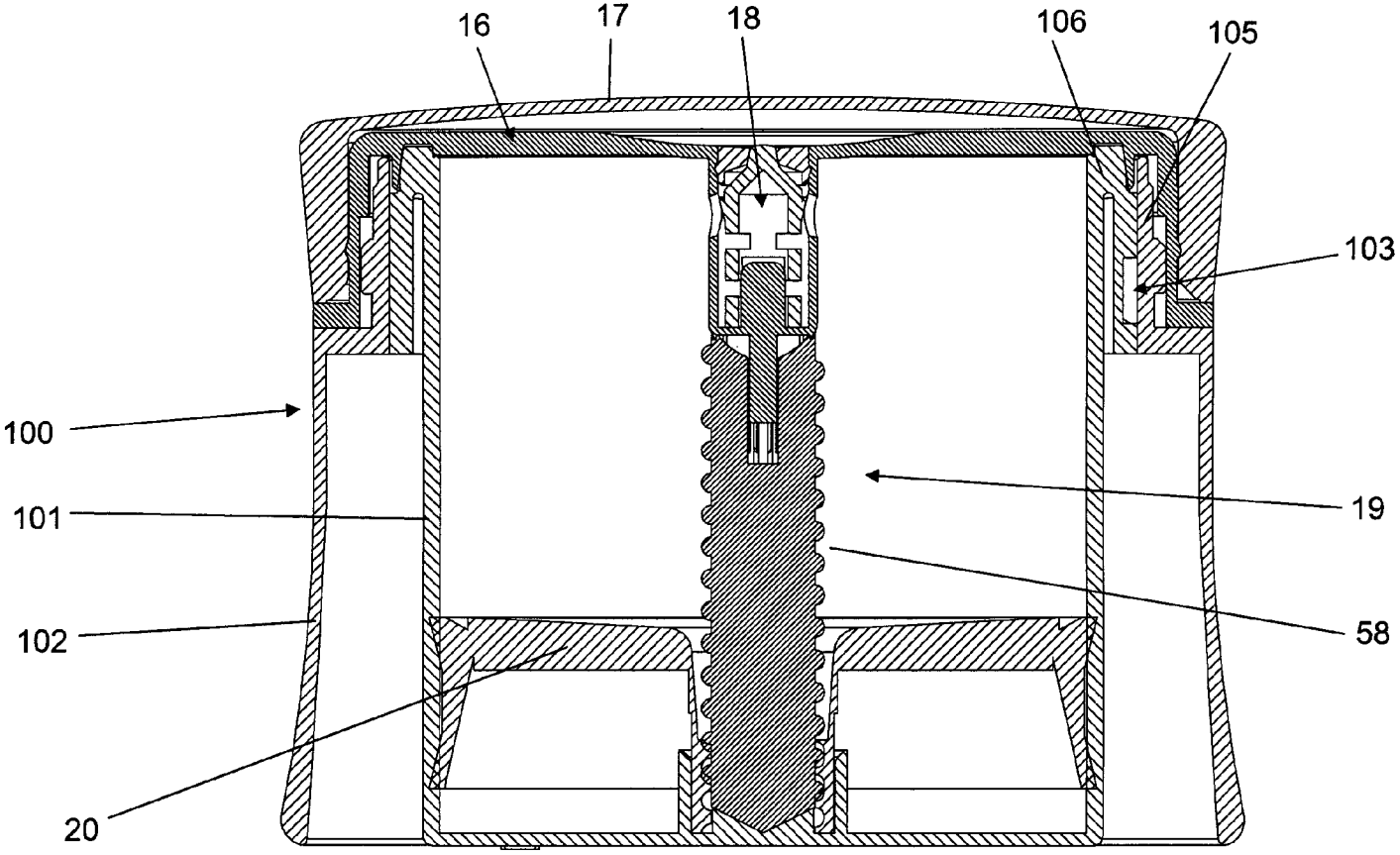
FIG. 15—Shows a side view in cut of the constructive variation for the refill mode package version.
Figure 16:
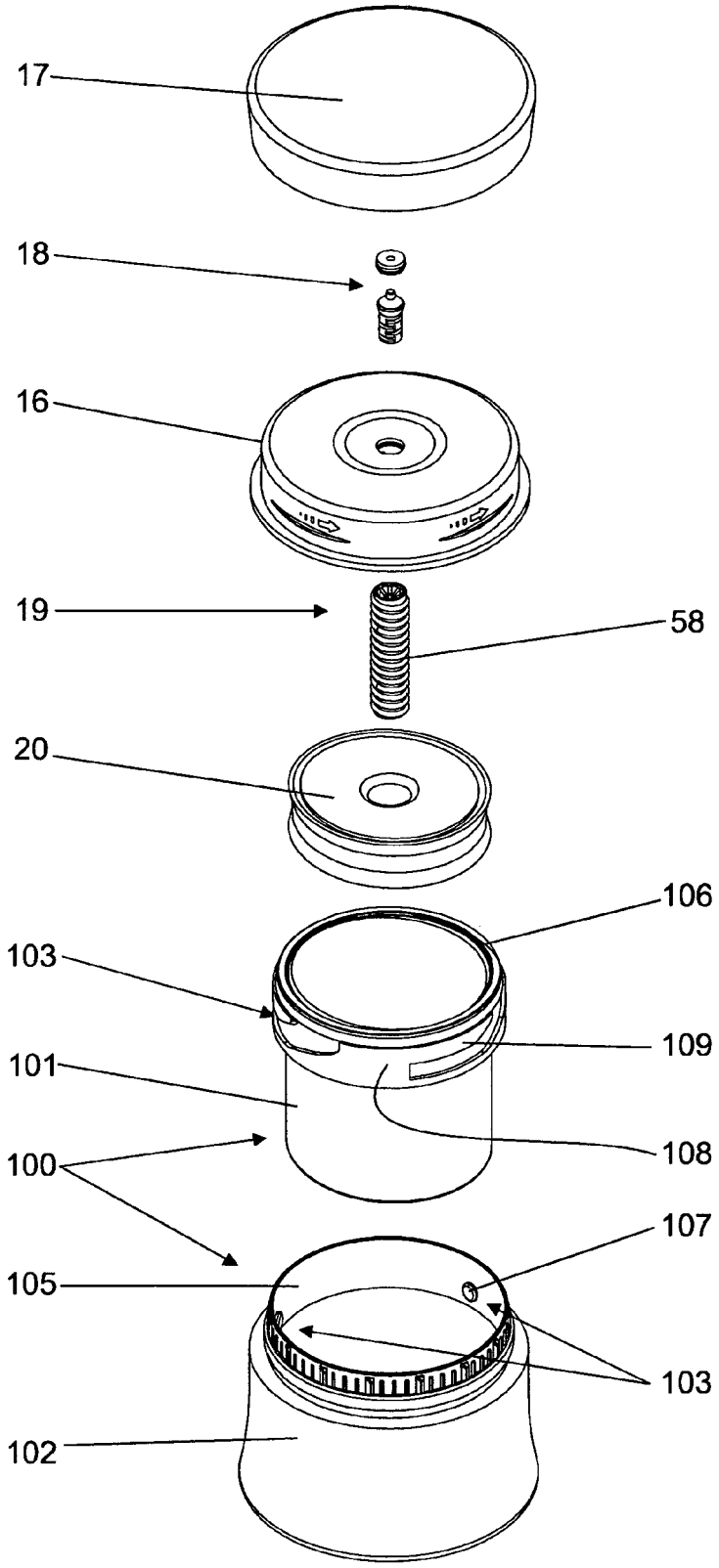
FIG. 16—Reproduces an exploded perspective view from a superior angle showing the refill package version.
Figure 17:
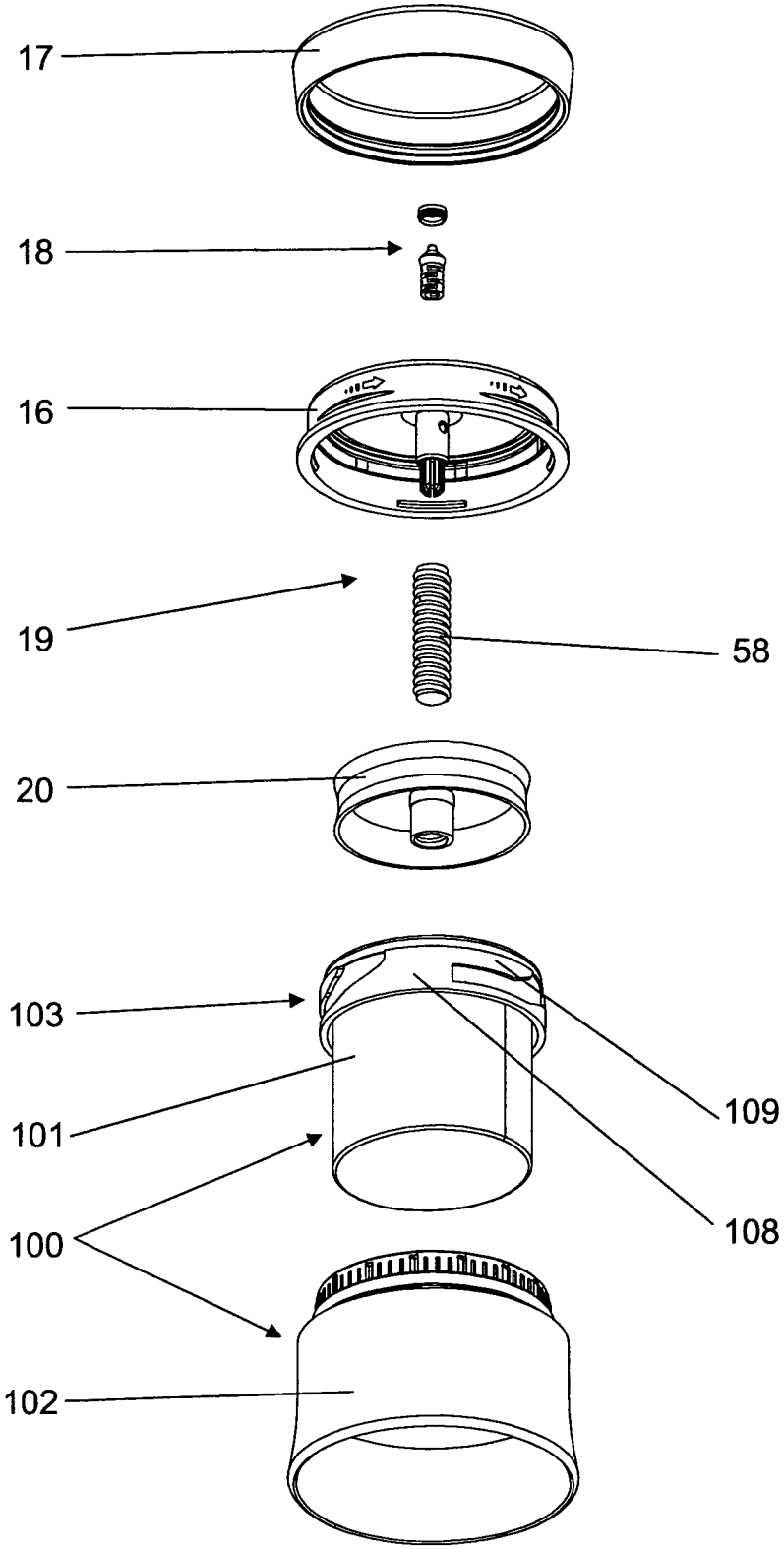
FIG. 17—Shows a similar exploded perspective from the refill package version as in FIG. 16, although, from an inferior angle.
Figure 18:
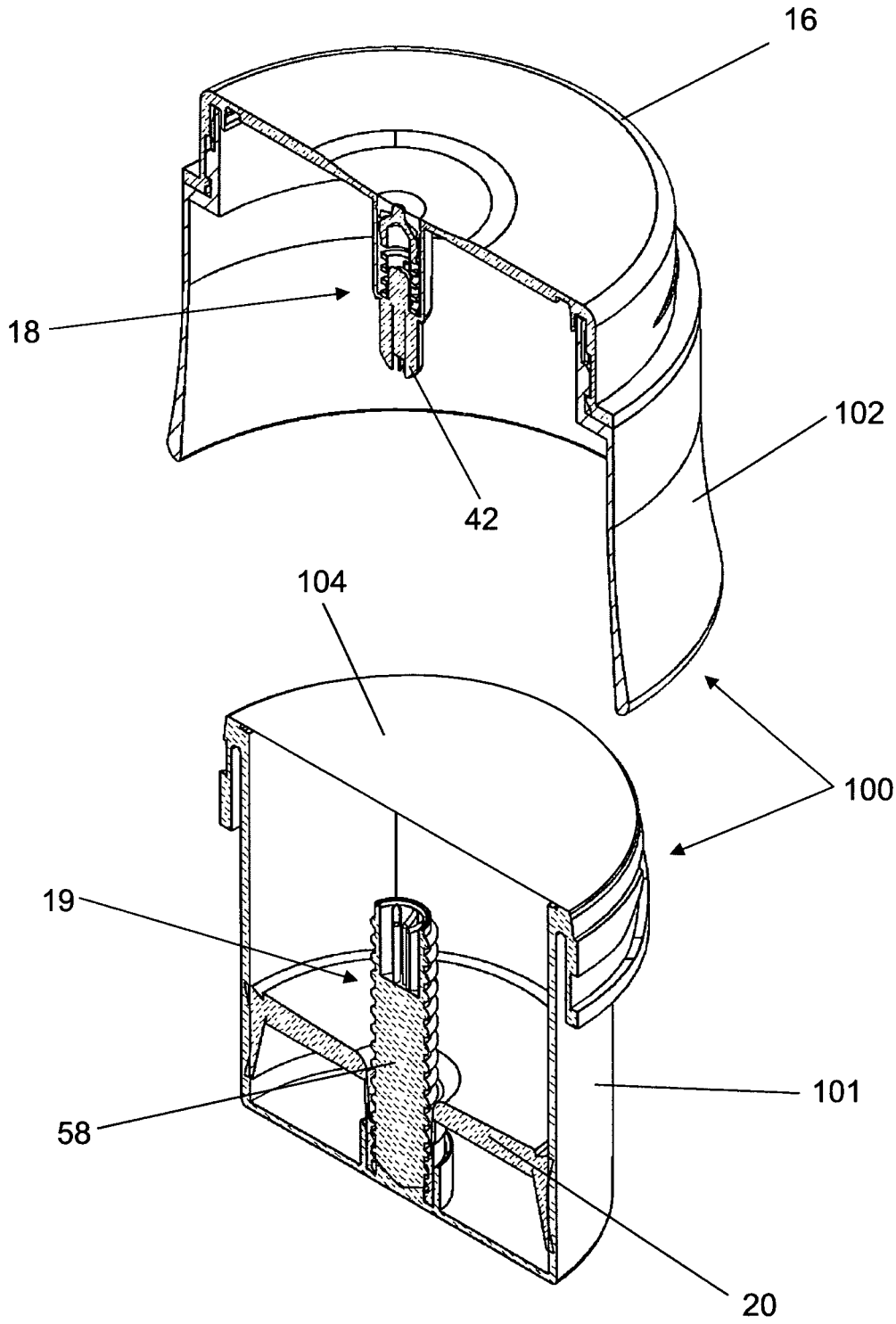
FIG. 18—Shows a perspective view in cut placing in the spotlight the permanent set and beneath the complete refill package set with the removable seal.
Figure 19:
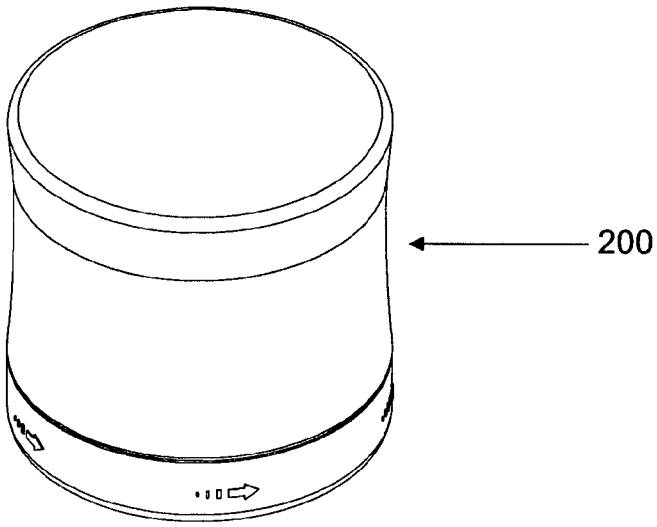
FIG. 19—Shows from a superior angle a perspective view of the package with the actioning system through the base.
Figure 20:
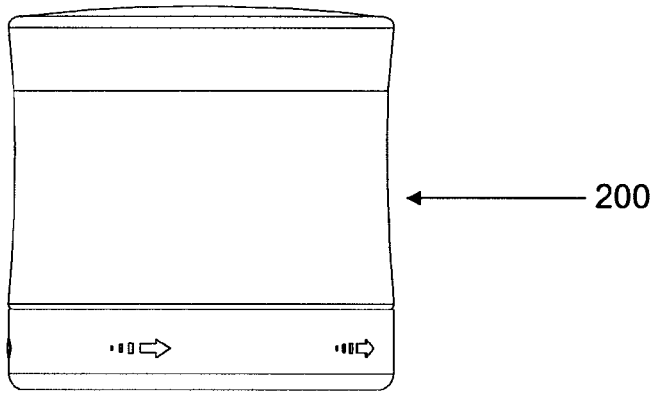
FIG. 20—Shows a side view of the package similar to the previous figure.
Figure 21:
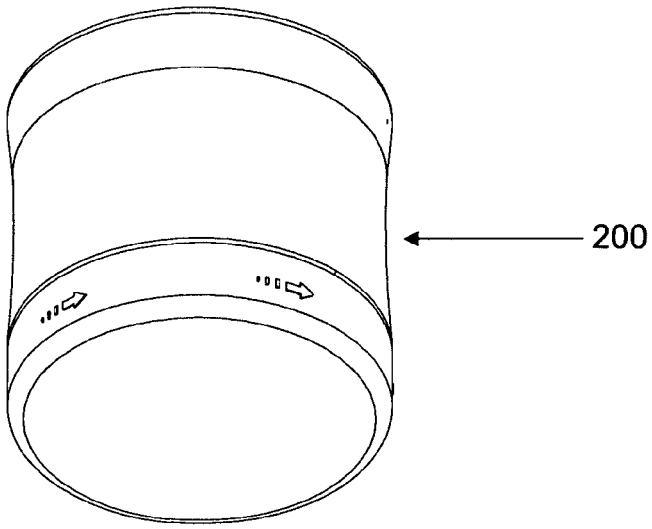
FIG. 21—Shows from an inferior angle a perspective view of the package with the actioning system through the base.
Figure 22:
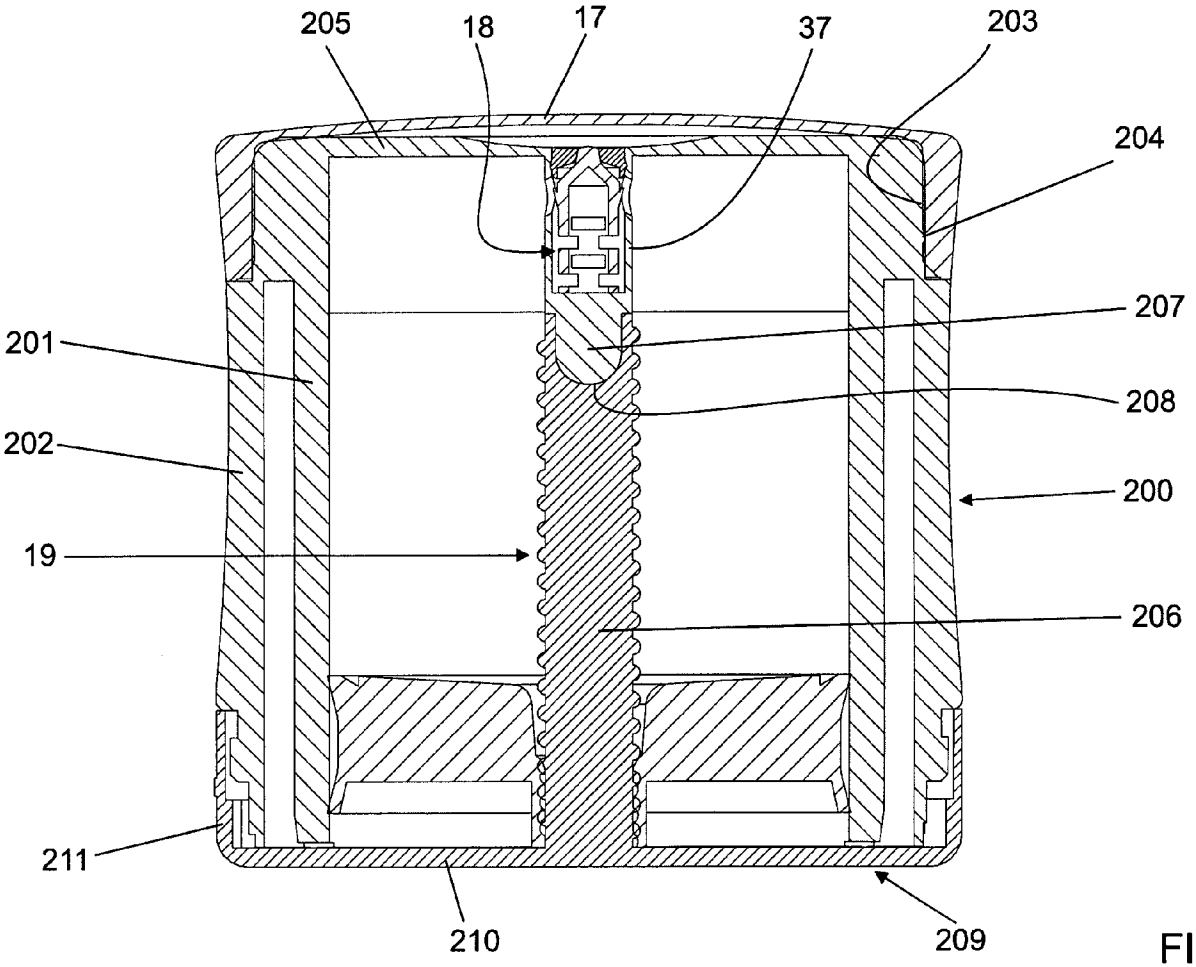
FIG. 22—Shows a side view in cut of the package with the actioning system from the base.
Figure 23:
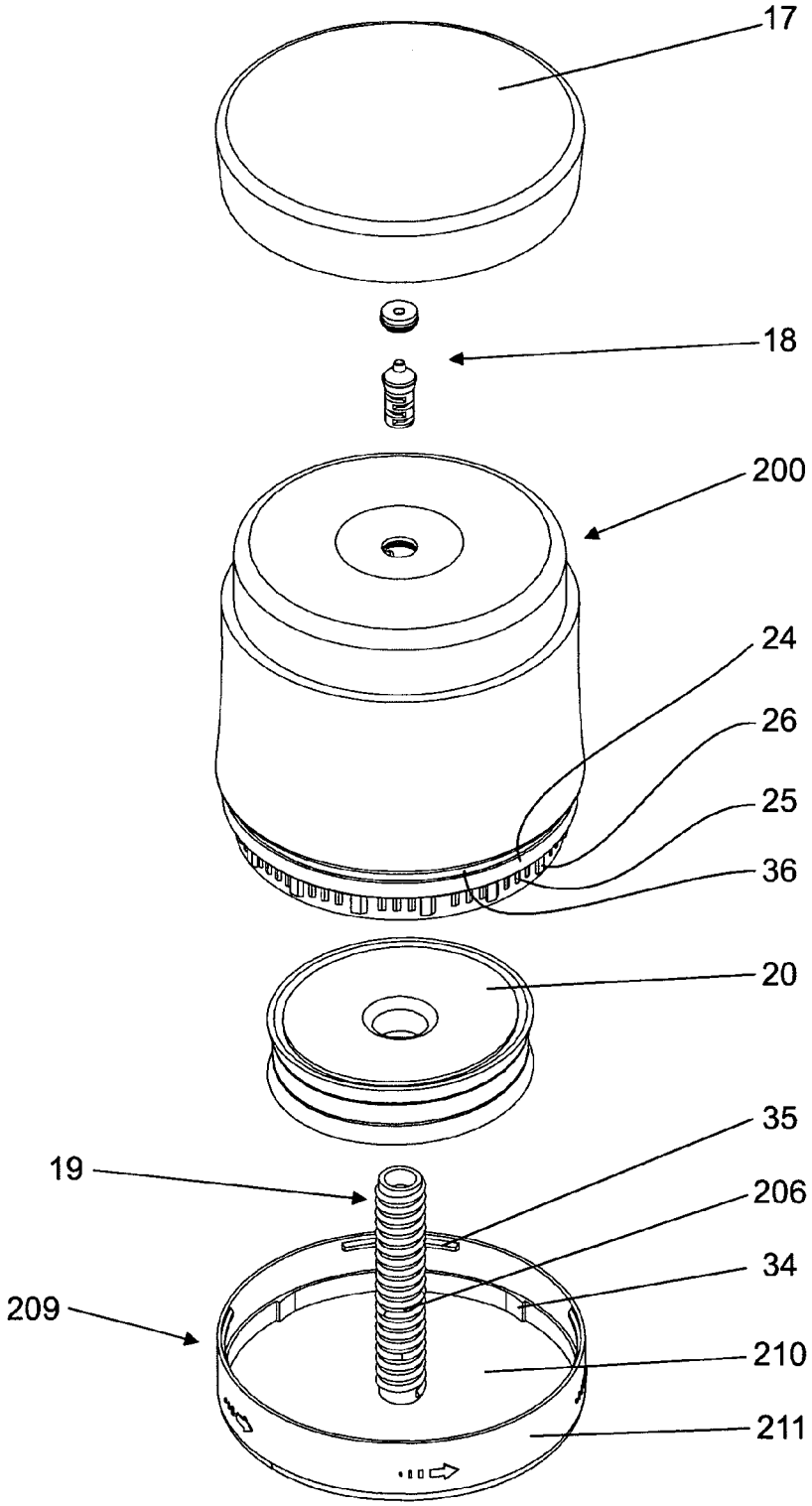
FIG. 23—Shows a perspective exploded view from a superior angle of the package with bottom actioning.
Figure 24:
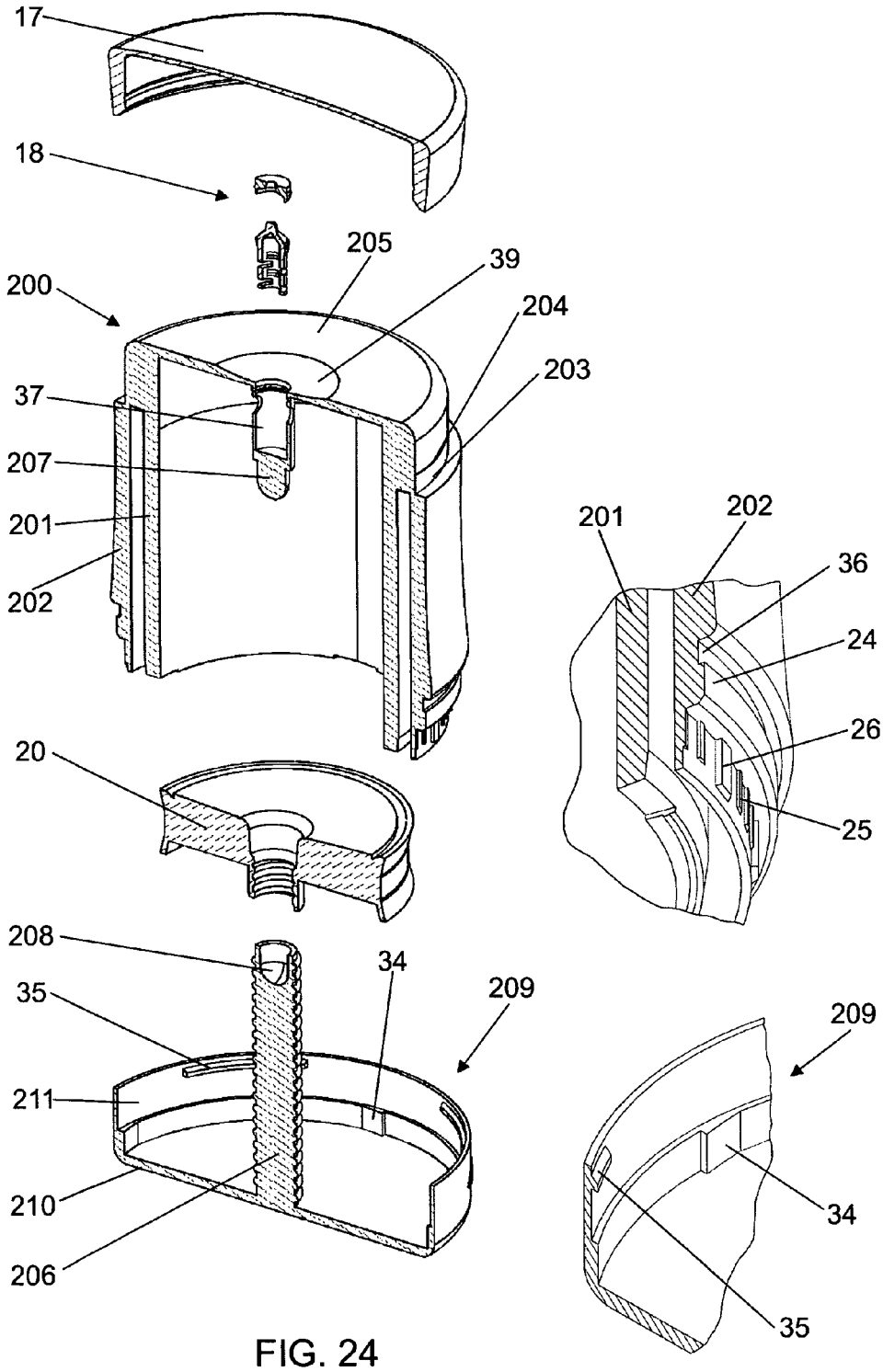
FIG. 24—Shows a similar view as in FIG. 23, although in transversal cut and with magnified details.
Figure 25:
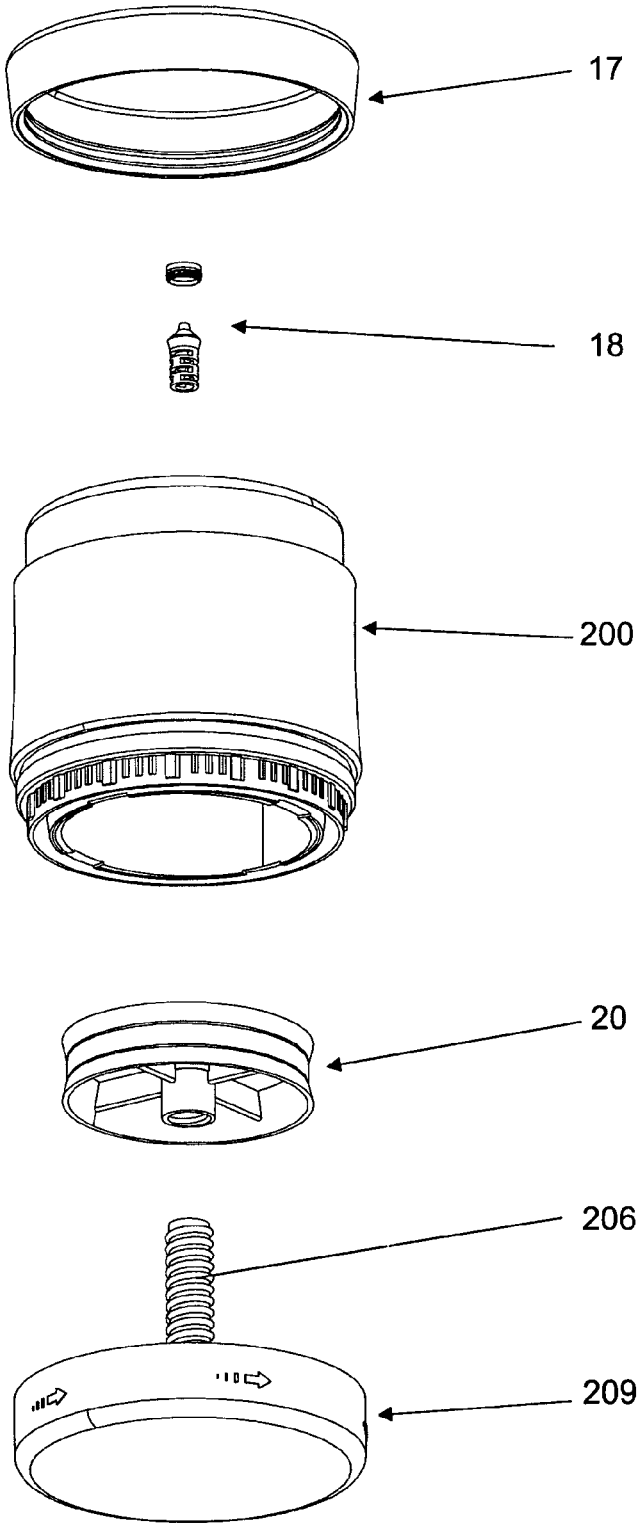
FIG. 25—Exhibits a perspective exploded view from an inferior angle of the package with the actioning system from the base.

FIG. 14 exemplifies the fact that the finishing skirt or cover or support (12) of the cup-like recipient (11) illustrated in the previous Figures is an item which constructive details may vary considerably to define any decorative or utility design, as well as said finishing cover or skirt is optional, consequently, may be completely eliminated without altering the functioning and the advantages of the set.

In another constructive variation of the system, the packaging in question, aims to reduce its environmental impact, including details to be a product partially disposable and reusable, for that it includes means for substitution of the cup-like recipient or the empty reservoir by a full cup-like recipient or reservoir, this last constitutes a refill which includes the cup-like recipient (101), the piston (20) and its screwed-rod (58), such as illustrated in FIGS. 15, 16, 17 and 18 where it shows that the set comprehends a modified body (100), composed by two independent pieces, being the first the cup-like recipient (101) preferably externally cylindrical and internally slightly oval, containing the product to be dispensed, while the second is a finishing cover or skirt (102), inside which inner part is placed the cup-like recipient (101), being that, for such, both have their ends endowed with means for fast coupling and uncoupling (103) cooperating to the set (FIG. 18) defined by said cup-like recipient (101) with the piston (20) and the screw-rod (58) (empty refill) may be removed and discarded, in order to be substituted by another equal set (full refill), and, in this case, the cup-like recipient (101) is temporarily sealed by a removable seal (104), which removal occurs manually in the moment prior to the refill is coupled in the inner portion of the cover (102) and, in this moment, that point with first fins (42) penetrates on the upper opening (59) of screw-rod (58) already assembled to the piston (20) inside the cup-like recipient (101) and consequently, the set is ready to be reused such as previously described, once the valve system (18) and the actioning mechanism (19) are exactly the same for the refill version.

In a preferred construction of the refill version, the means for fast coupling and uncoupling (103) are preferably constructed in a bayonet-like form, in such, the cup-like refill recipient (101) and the cover (102) present in their top ends collars which adjust concentrically (105-106), where the collar (105) from the cover presents its internal side endowed with minimum two protrude radial bolts (107) oppositely placed from one another, while at the external side from the collar (106) of the cup-like refill recipient (101) presents a female coupling formed by channels with vertical inlet portions (108) connected to short horizontal portions (109), both cooperating for the penetration and reversible locking of the radial bolts (107), consequently, it is possible to couple or uncouple the cup-like refill recipient (101) from the under part the skirt (102) and at the same time it is possible to keep the hermetic sealing of the system when coupled.

In a preferred constructive variation, illustrated in the FIGS. 19 to 25, the package in question presents its actioning mechanism assembled in the bottom part of the set (body), although keeping many constructive details of the previous versions since in this version occurs is the inversion of the actioning components, so that it is provided a modified body (200) in a sole piece formed by two parts, one being the cup-like recipient or reservoir (201) and the other the finishing cover (202), which top ends are integrated to each other and, in this point, exists an external diameter reduction (203) with coupling (204) details and a slight locking for the overlid (17), as well as this part of the body (200) is closed by a top wall (205), in which central portion is positioned the protection dosing valve (18), that, by its turn is coupled with the actioning mechanism (19) and piston (20), being that, in this case, said actioning mechanism (19) has a modified screwed-rod (206), which modified top end is spin-coupled by male-female coupling define by a rounded bottom tip (207) which develops vertically down from the dosing chamber (37) and protection dosing valve (18), said tip which penetrates in the cavity (208) existing at the top end of the screwed-rod (206), which bottom end is integrated in a whole piece with a spinning base (209), practically in the shape of a spinning disc, having a back wall (210) and a circular skirt (211), in which, this last is coupled in a rotational form towards the external diameter of the skirt bottom end (202), where its rotation is equally accomplished step by step and always in the same plane in relation to the body (200), being that, for such, the external diameter of the skirt bottom end (202) has the same constructive details defined by the teeth (25-26), ring salience (24) and channel (36), over which act the coupling projections (35) and tabs (34) provided in the inner portion of the skirt (210) of the base (209), in a way that this last may be rotated (pace) and displace always in the same direction and in the same plane in relation to the main body (201), so that the piston (20) moves upwards generating enough pressure in the inner portion of the cup-like recipient (201) for the product dosage to be dispensed, such as described previously, through the dosing chamber (37) and through the dosing valve (18).

Therefore, the actioning mechanism of this version, although accomplished by the bottom of the package, is practically the same in relation to the previous versions, having as the basic difference the fact that the modified screwed-rod (206) is integrated with the base (209), where the turnstile system is also assembled.

Figure 26:
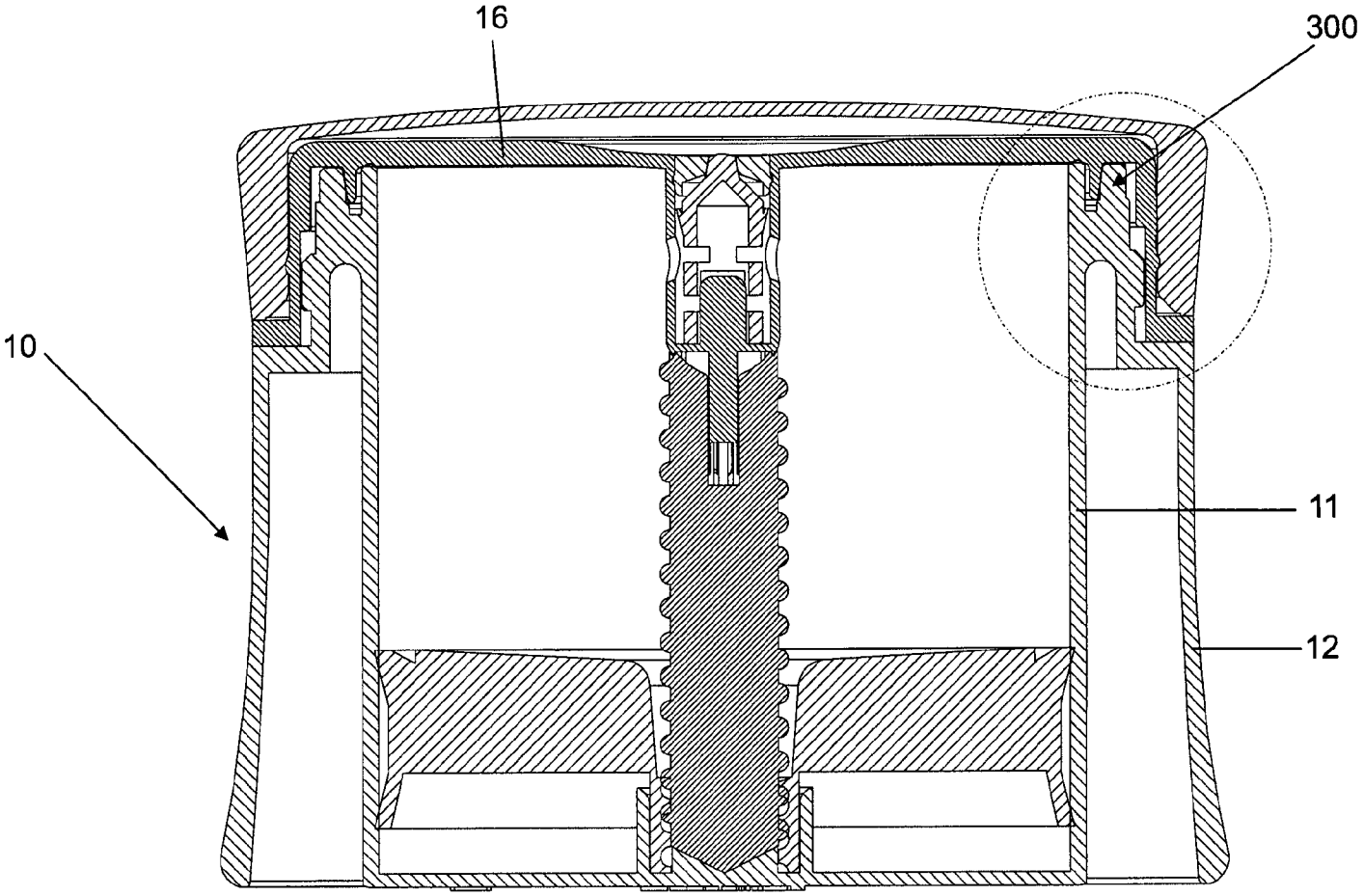
FIG. 26—Shows a view in transversal cut of the version without refill, although, with details of another constructive version for the sealing between the spinning disc and the body which configures the cup-like recipient and the finishing cover or skirt.

FIG. 26 illustrates a version of the package without the refill system and with a constructive variation for the sealing (300) between the spinning disc (16) and the body (10) which integrates the cup-like recipient (11) and the cover or skirt (12).

Figure 27:
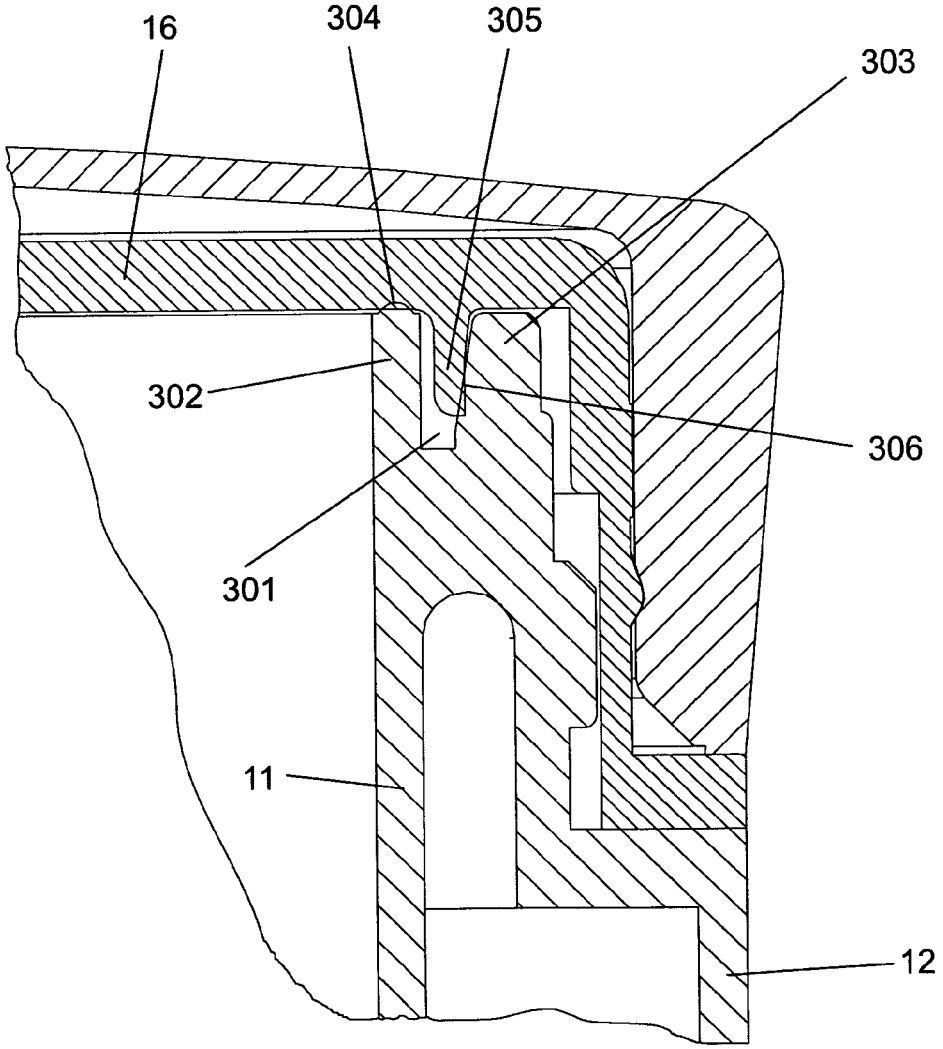
FIG. 27—Shows a magnified detail of the previous figure highlighting the constructive variation of said sealing.

The sealing (300) is illustrated with details in the magnified FIG. 27, though which is possible to verify that such sealing is defined by an ordinarily modified groove in the shape of a "V" (301) configured on the top joining of the cup-like recipient (11) and the cover or skirt (12), such top which forms the concentric collars (302-303) modified, in which the inner one has a salience integrated that configures the sealing ring on the top part (304) over which is pressed the bottom surface of the spinning disc (16), that in this same face has a concentric cylindrical lip of reduced height (305), practically in the shape of a circular guide or trail, oriented to fit in the modified channel (301), which in face of its larger diameter (306) is slightly bent and against the lip (305) with a certain pressure or interference, and consequently, this coupling effect with interference granted by the sealing lip (305) at the groove (301) and the effect of the pressure between the top ring (304) and the bottom surface of the spinning disc (16) concurs to characterize an optimum hermetic sealing of the said spinning disc (16).

Figure 28:
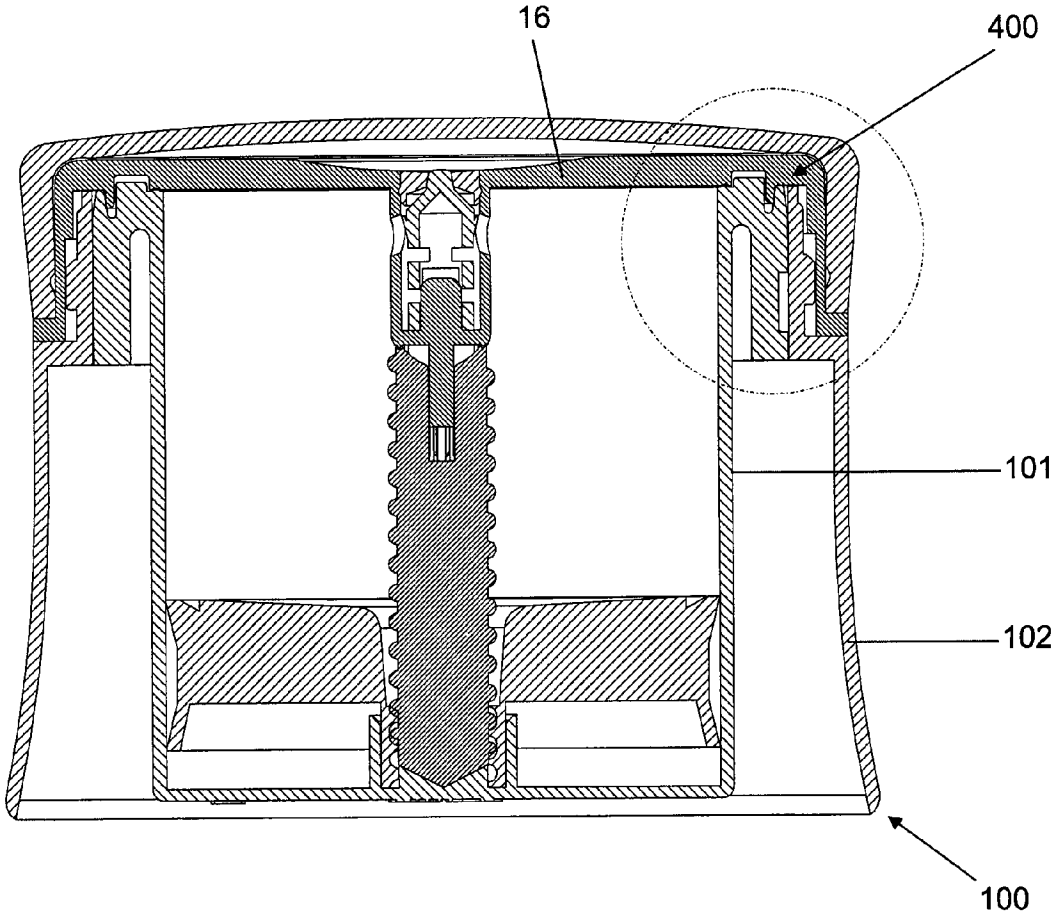
FIG. 28—Represents a view in transversal cut of the refill version, although, with details of other constructive version for the sealing between the spinning disc and the body which configures the cup-like recipient and the finishing cover.

FIG. 28 illustrates the refill package version and with a constructive variation for the sealing (400) between the spinning disc (16) and the body (10) formed by the cup-like recipient (101) and the cover or skirt (102).

Figure 29:
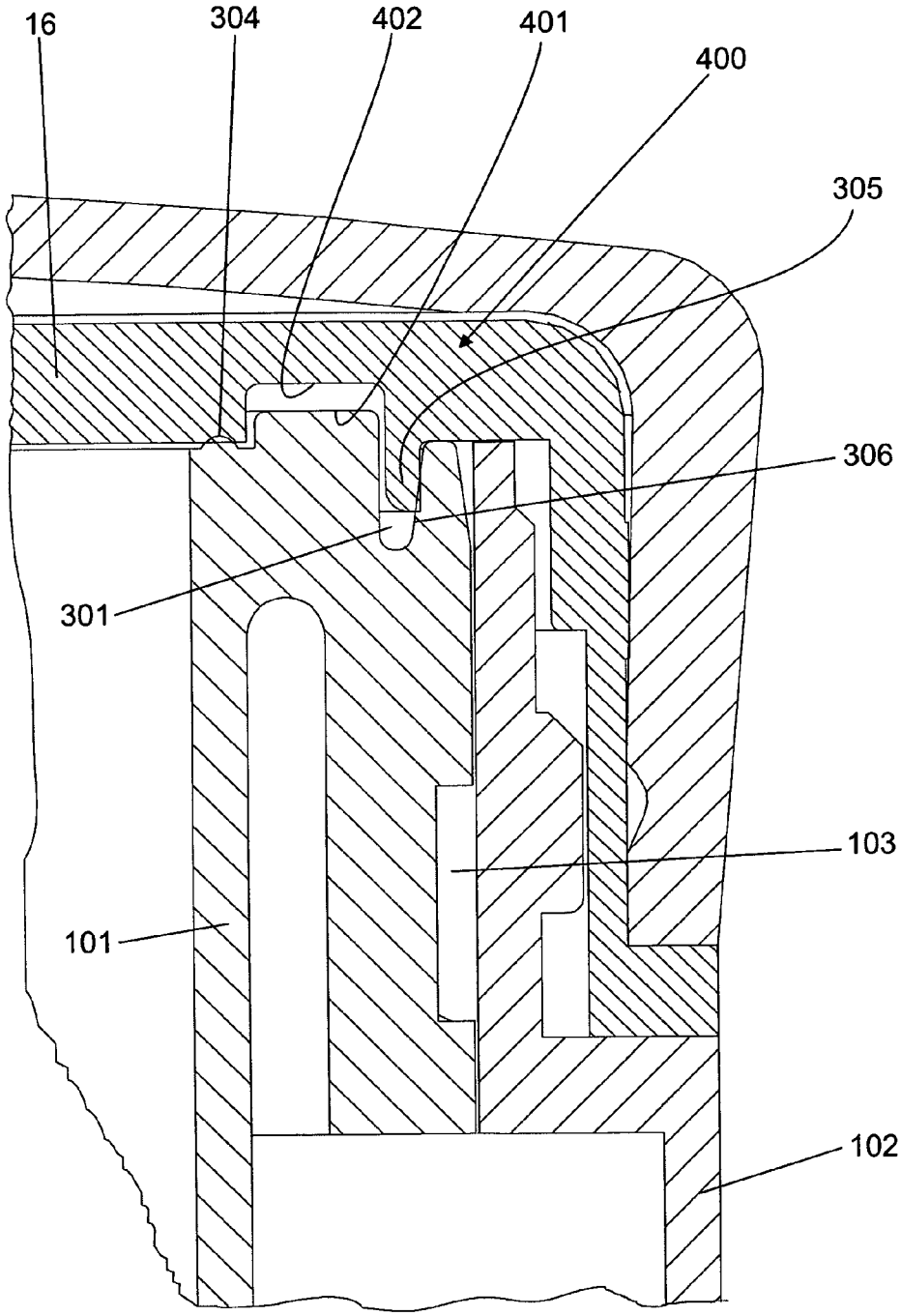
FIG. 29—Shows a magnified detail of the previous figure, highlighting the constructive version of said sealing of the refill version.
Figure 30:
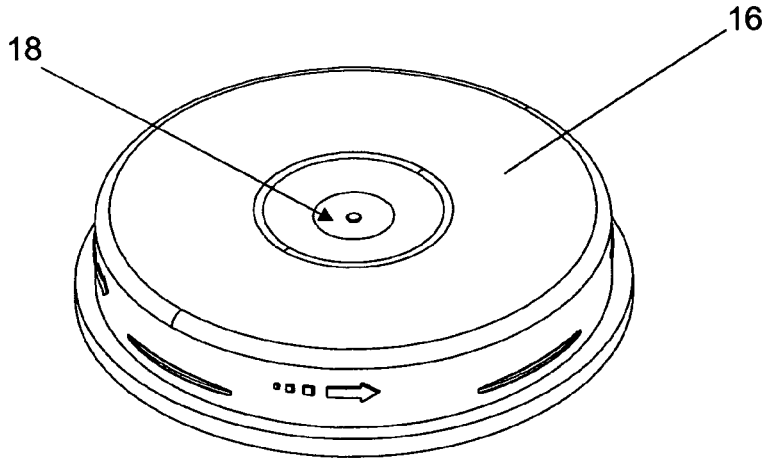
FIGS. 30 and 31 represent perspectives from different angles showing a constructive variation of the valve.
Figure 31:
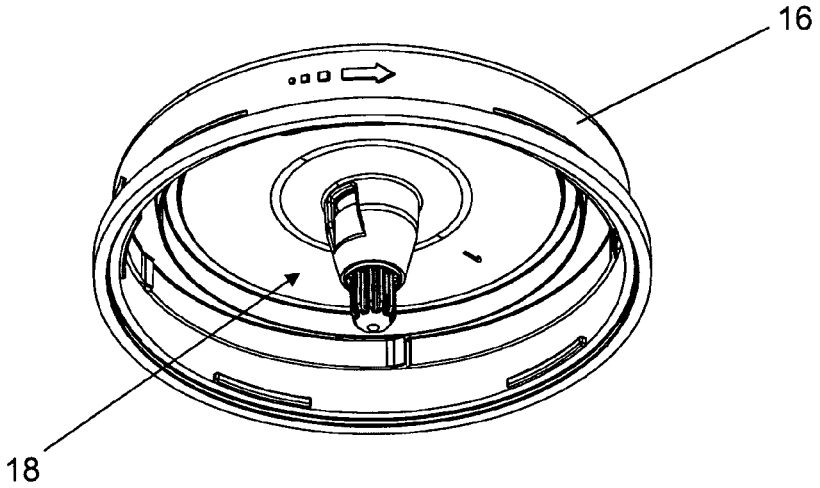
Figure 32:
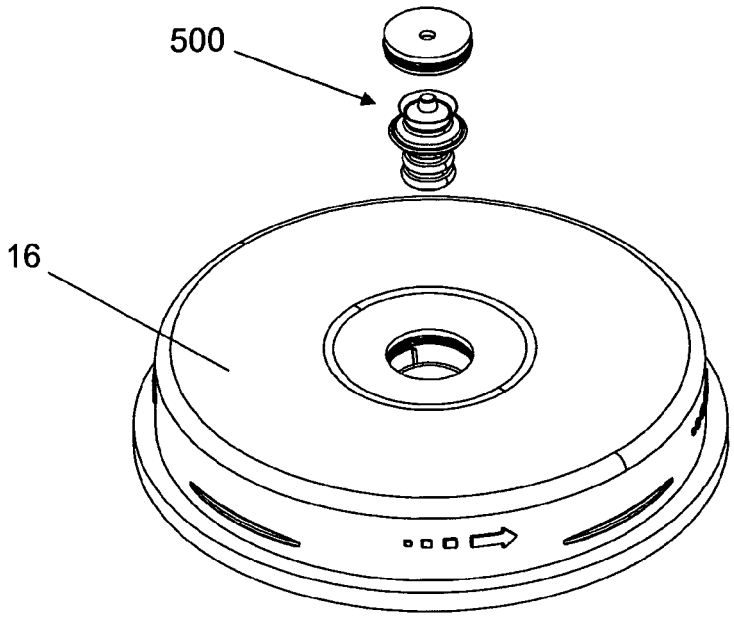
FIGS. 32 and 33 show exploded perspectives of the second constructive version of the valve.
Figure 33:
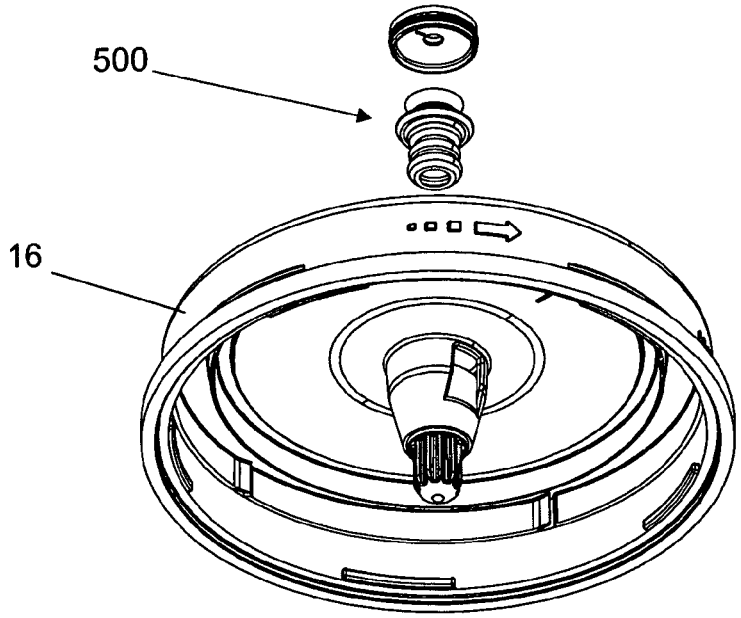
Figure 34:
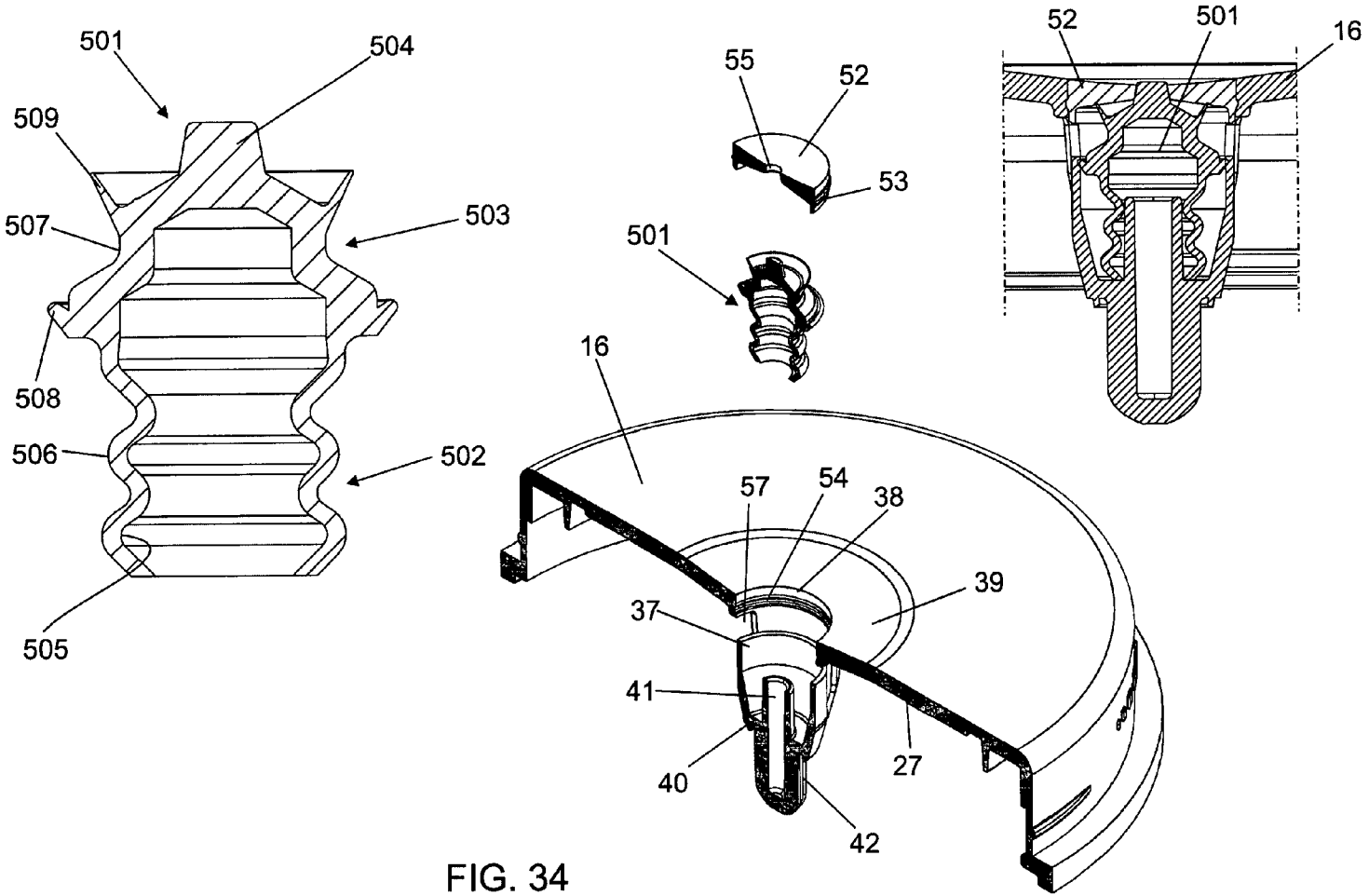
FIGS. 34 and 35 illustrate exploded, cut-way perspectives and amplified details, also cut-way, highlighting the constructive details of the second constructive version of the valve.
Figure 35:
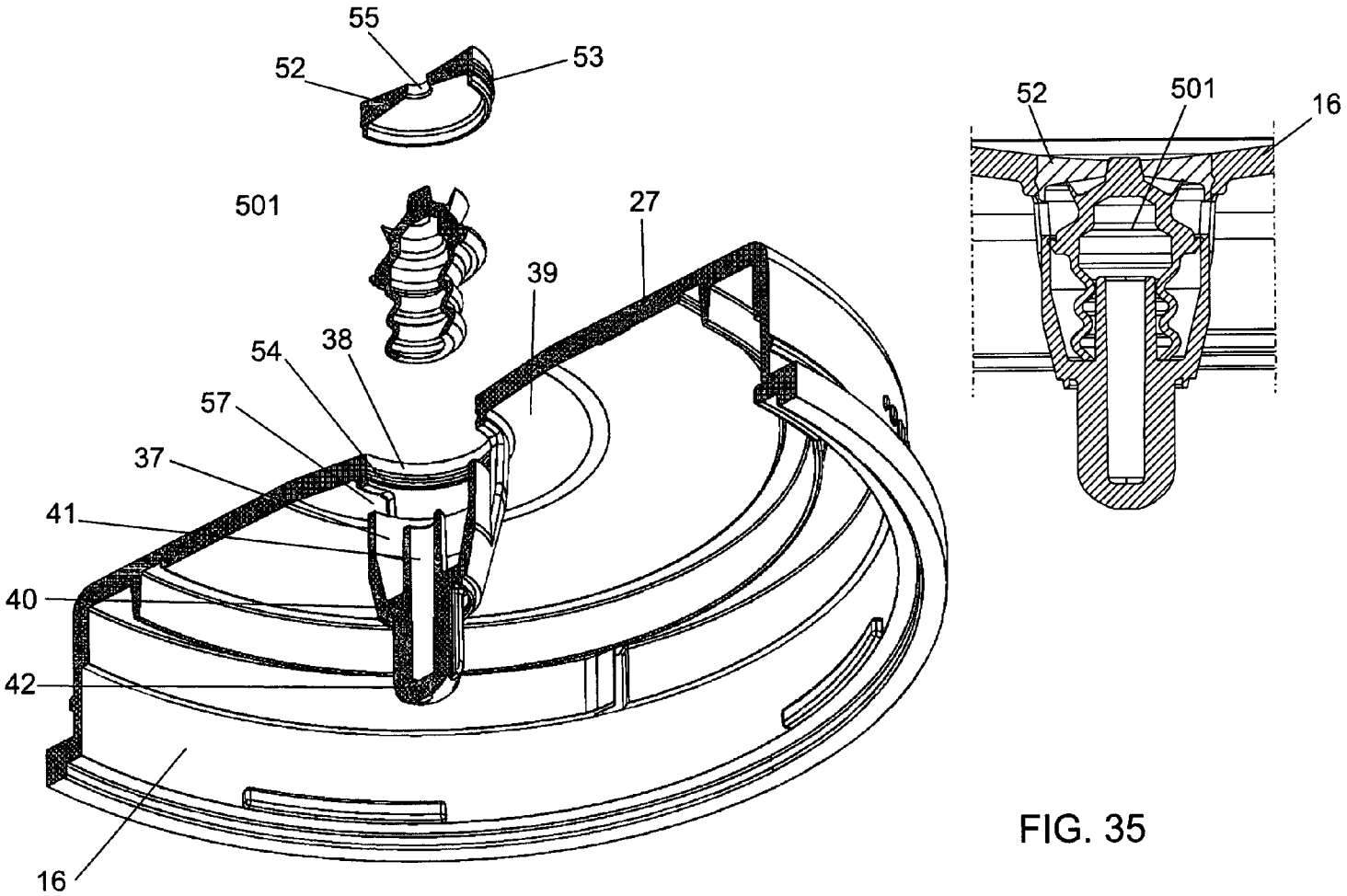
Figure 36:
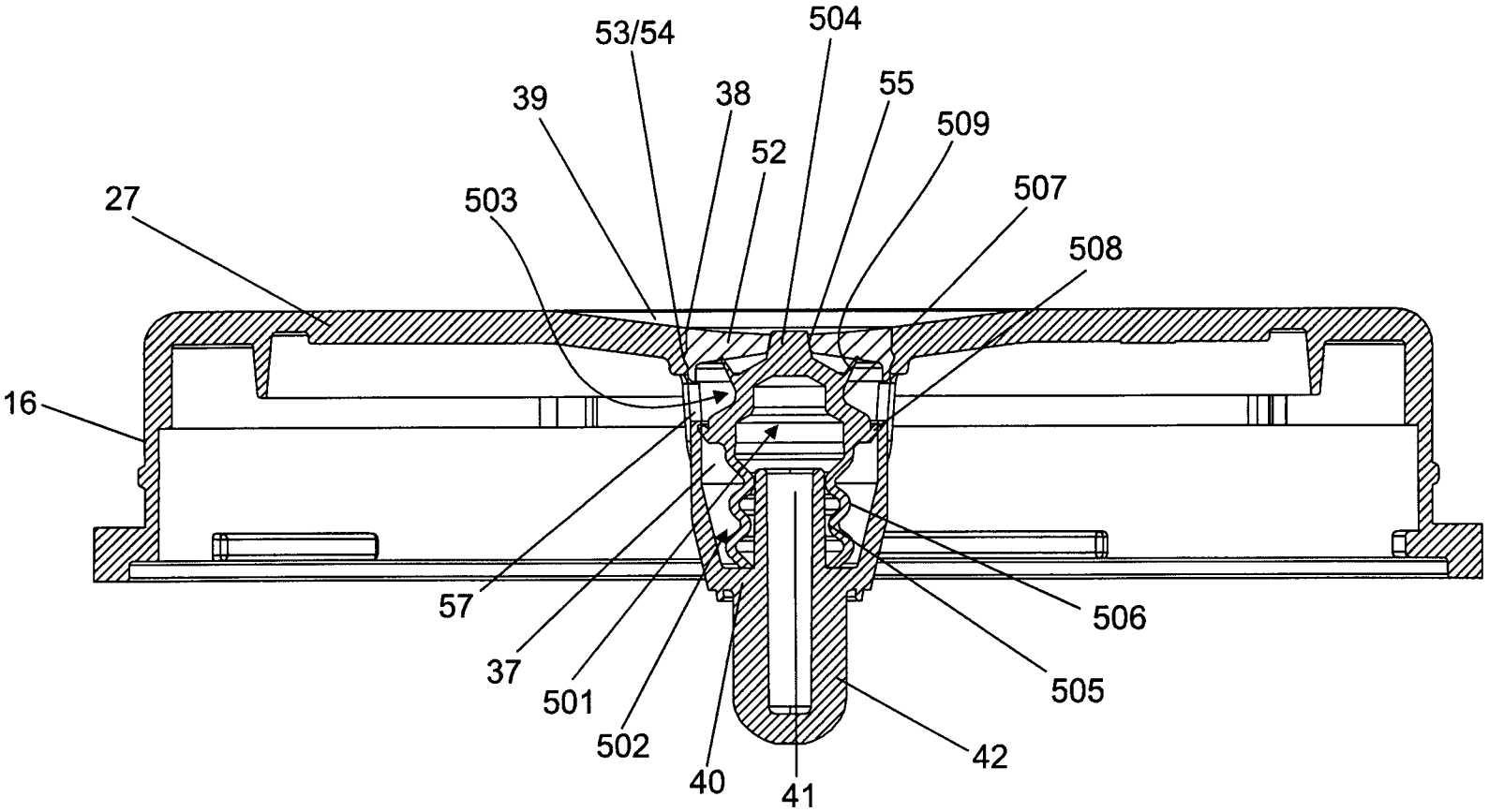
FIG. 36 is a side, cut-way view of the spinning disk with the valve of the second constructive version.
Figure 37:
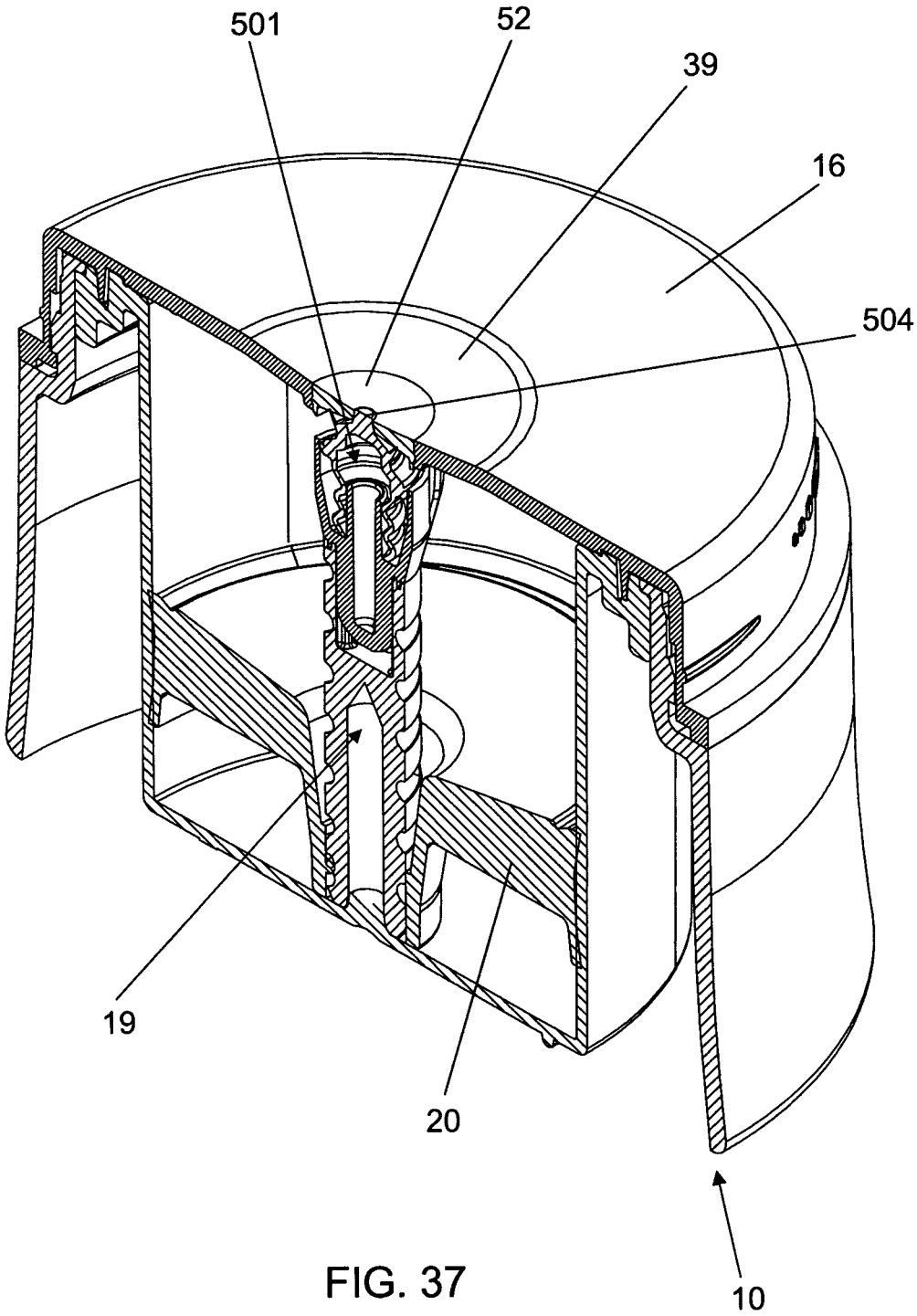
FIG. 37 shows a cut perspective of the packaging shows a cut-way of the packaging assembled with the second constructive version of the valve.
Figure 38:
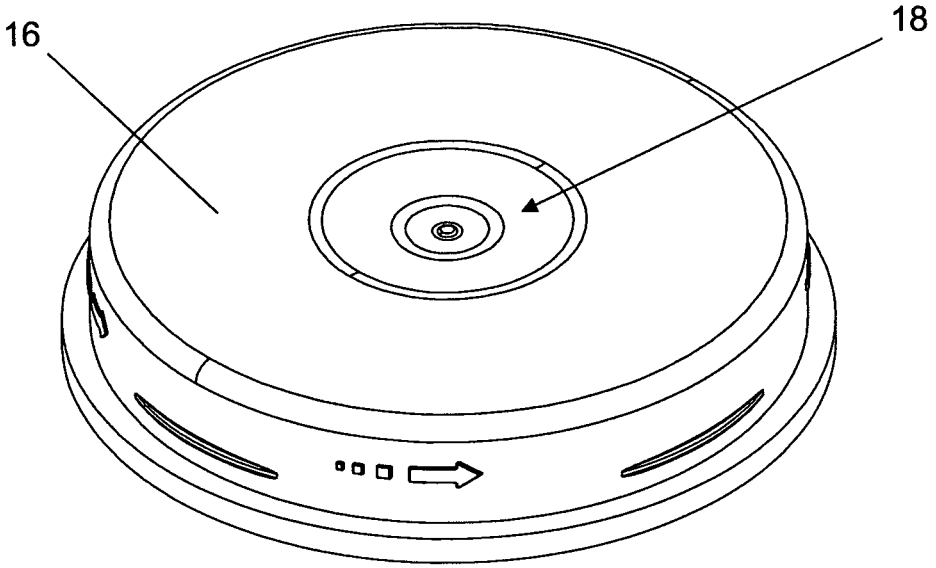
FIGS. 38 and 39 represent perspectives from different angles showing the third constructive variation of the valve.
Figure 39:
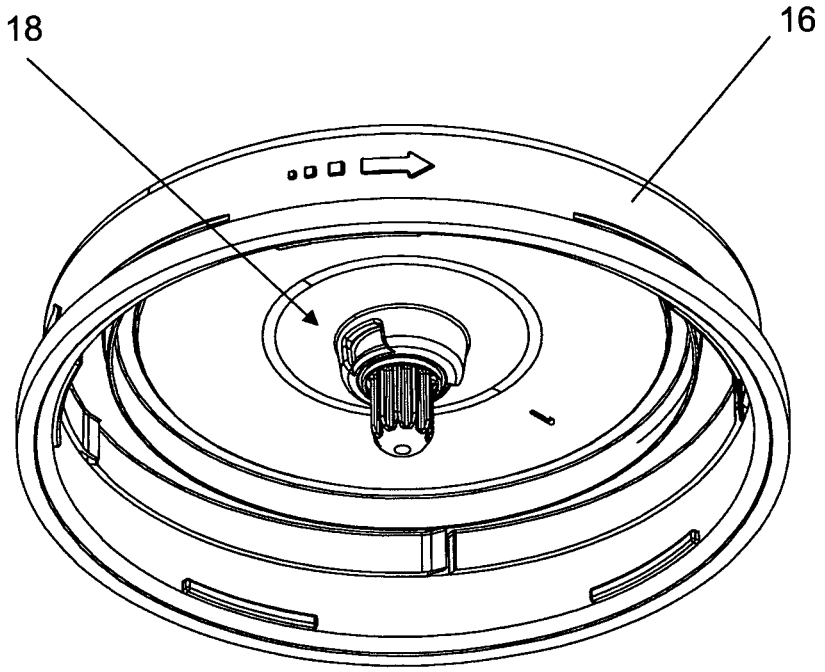
Figure 40:
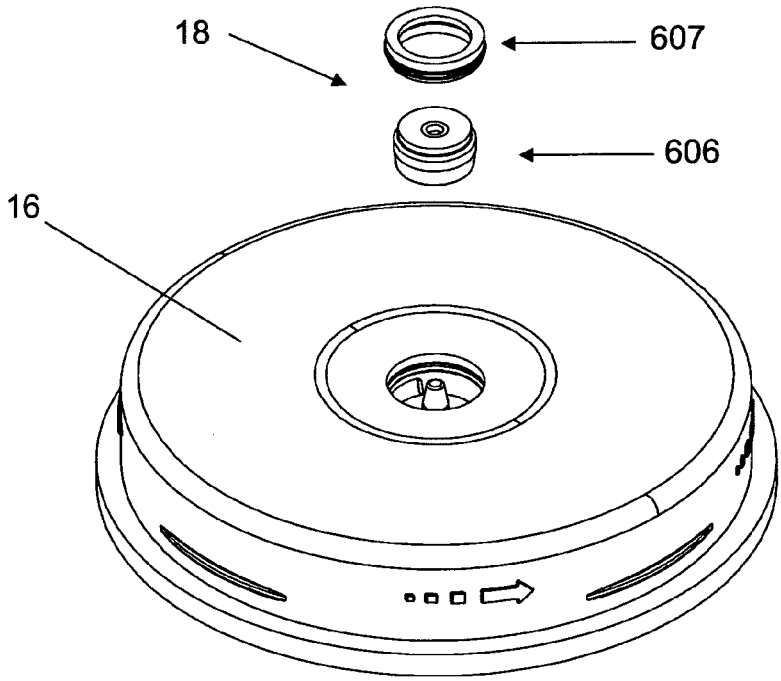
FIGS. 40 and 41 show exploded perspectives of the third constructive version of the valve.
Figure 41:
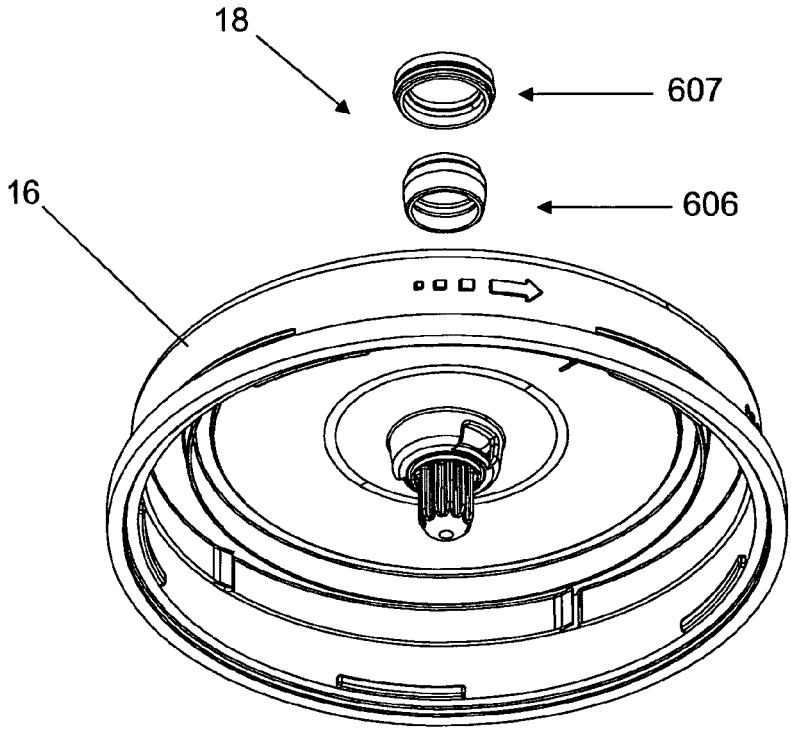
Figure 42:
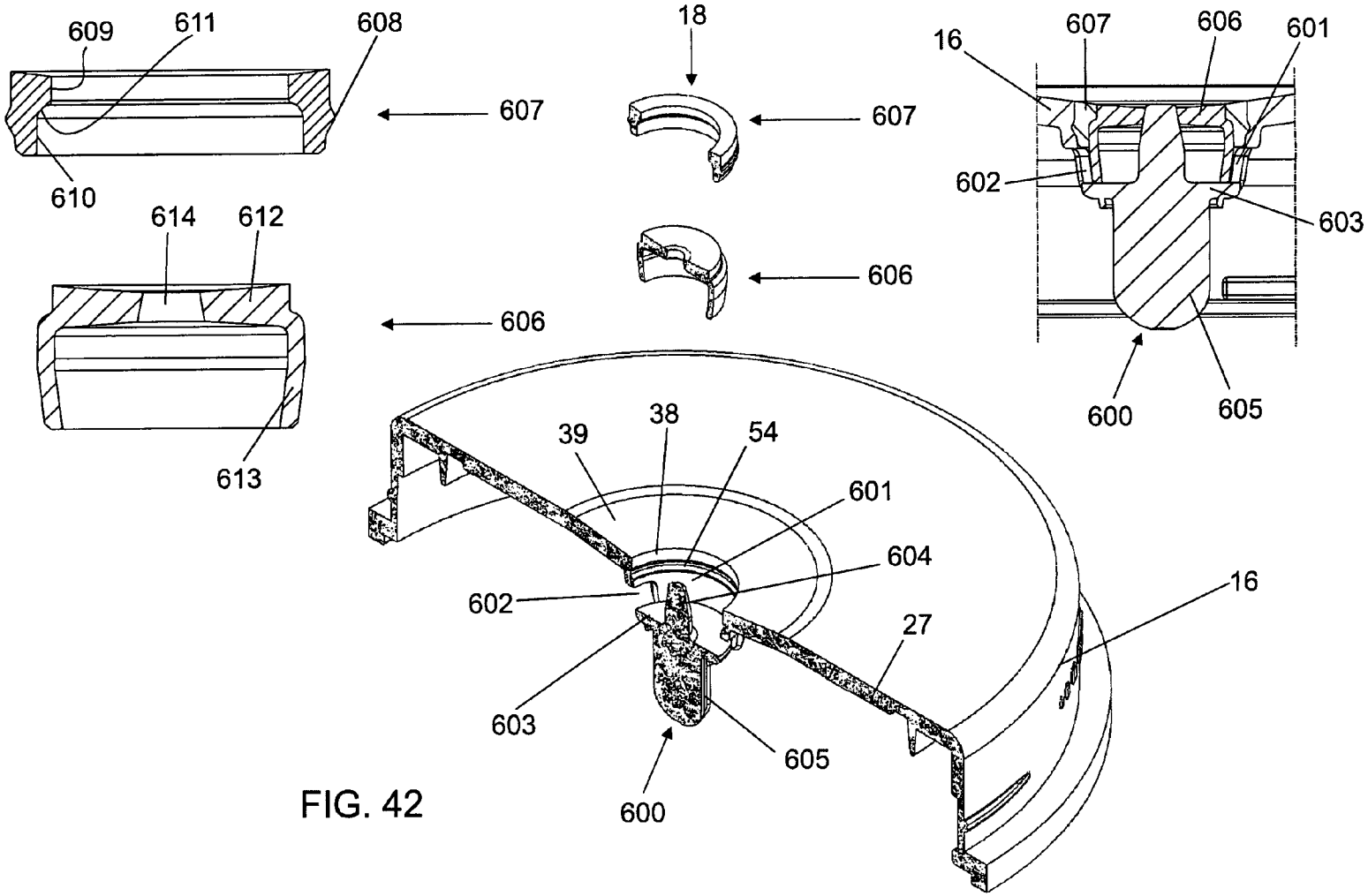
FIGS. 42 and 43 illustrate exploded, cut-way perspectives and amplified details, also cut-way, highlighting the constructive details of the third constructive version of the valve.
Figure 43:
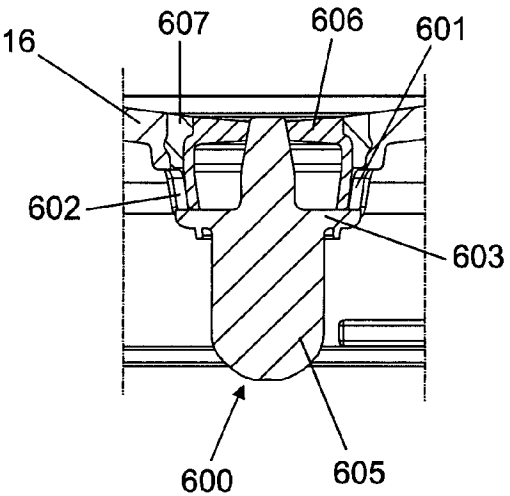
Figure 43:
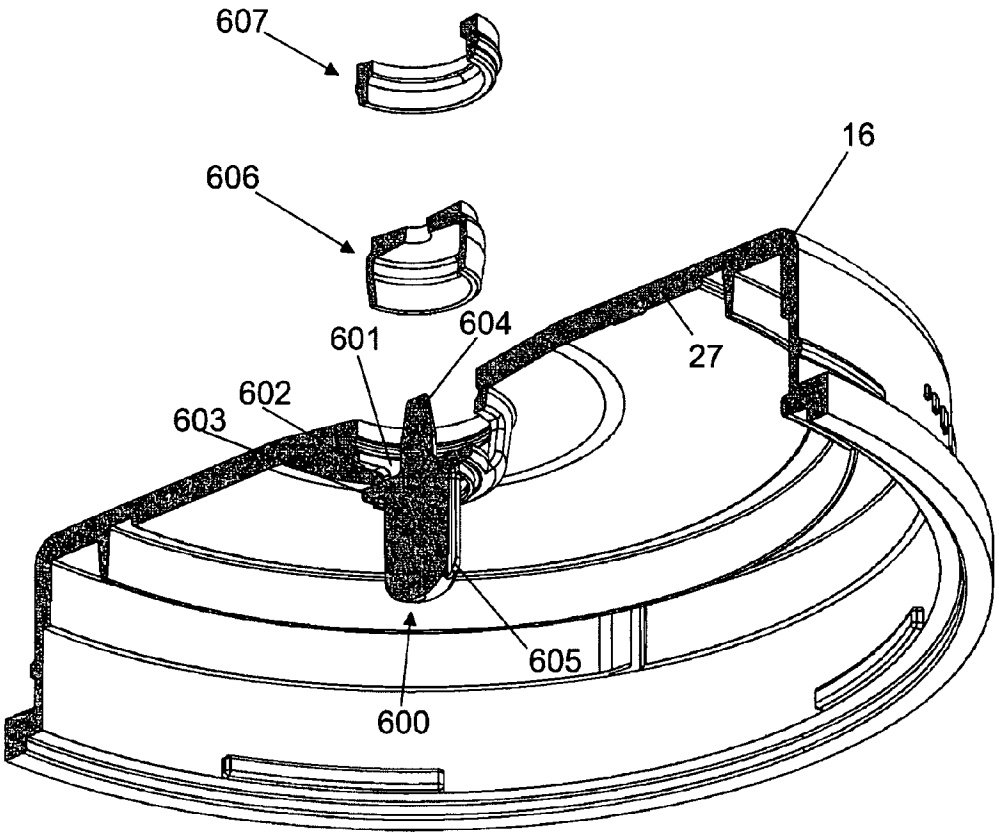
Figure 44:
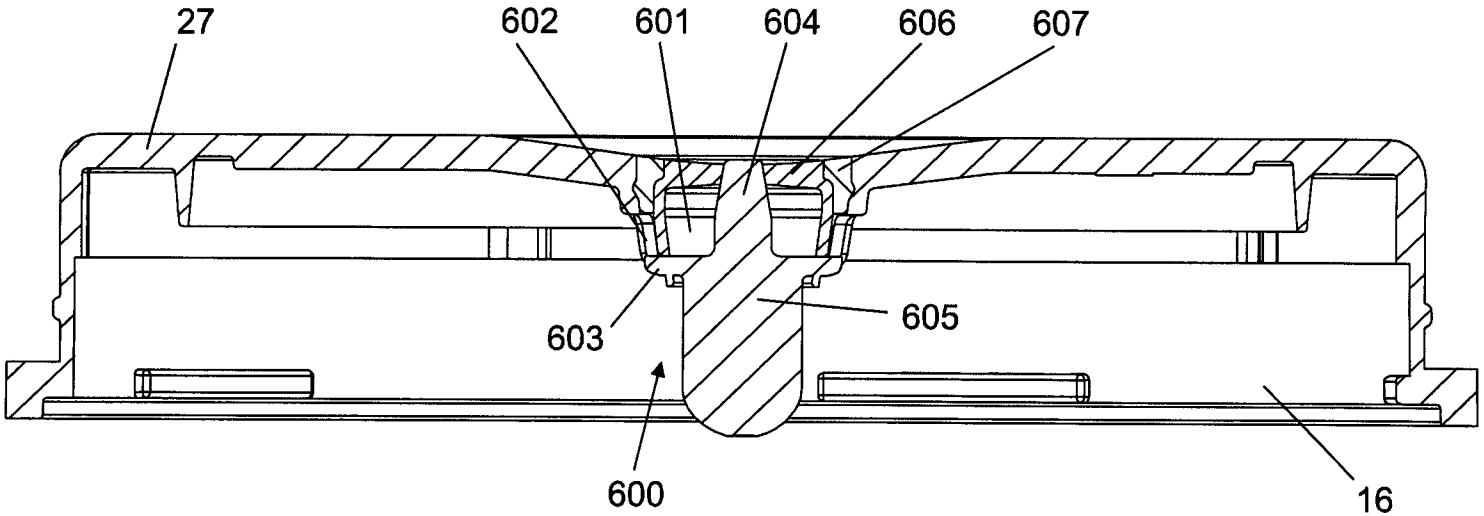
FIG. 44 is a side cut-view of the spinning disk with the valve of the third constructive version.
Figure 45:
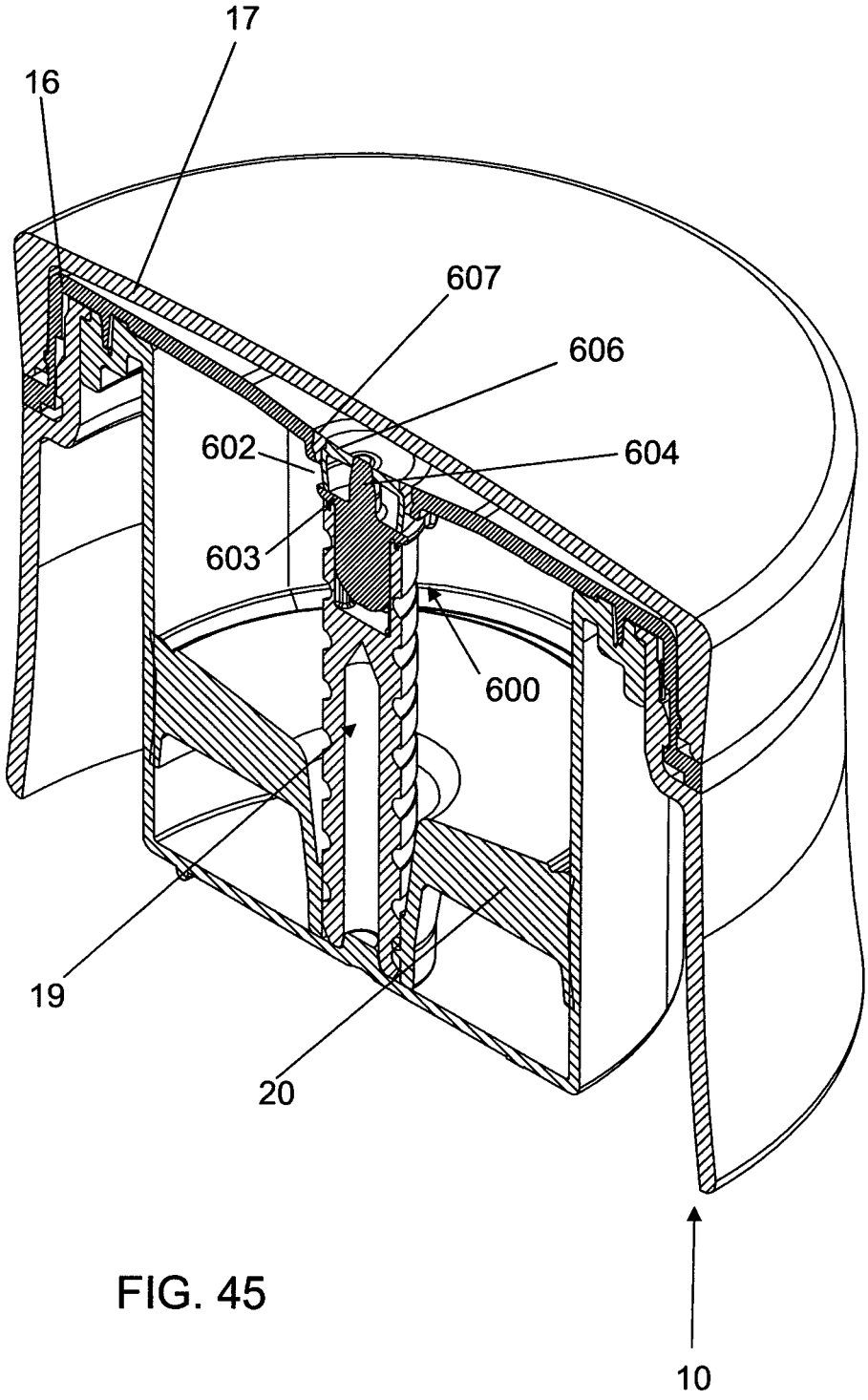
FIG. 45 shows a cut-way perspective of the packaging assembled with the third constructive version of the valve.

The seal (400) is illustrated with details in the FIG. 29, through which it is possible to verify that the sealing is equally achieved by the ordinarily modified groove in the shape of a "V" (301) and the sealing ring salience (304), both on the top part of the wall of the cup-like recipient (101), in which external diameter is coupled, through the engage (103) and the corresponding wall of the finishing cover or skirt (12), being that, between the channel (301) and the circular ring sealing salience (304), the top of the wall of the cup-like recipient (101) includes another ring salience which configures a male coupling (401) which penetrates without any interference in this female coupling point (402) existing in the bottom face of the spinning disc (16).

In this constructive version, the sealing effects occur in the same way, that is, over the ring salience (304) tensioned against the inferior surface of the spinning disc (16), while the lip (306) is oriented to penetrate the modified groove (301), which faces of major diameter (306) being slightly bent against with the said lip (305) maintaining a certain pressure or interference, consequently, this effect of coupling with interference granted by the sealing lip (305) at the groove (301) and the effect of the pressure between the ring top (304) and the bottom face of the spinning disc (16), concur to characterize an optimum hermetic sealing of the said spinning disc (16) in the refill version.

The male and female couplings (401-402) function like a guide trail during the disc spinning (16), keeping the whole set steady.

The tip of the salience (401) serves, as well, as a fixation area for a removable temporary seal (104), used to assure the tight sealing of the refill cup-like recipient (101), before it is coupled to the top portion of the system or cover (102).

FIGS. 30 to 37 show constructive details of another preferred embodiment for the valve (18), maintaining the same drive in the form of a spinning disk (16), including the tubular dosing chamber (37), whose top end is entirely open and is integrated with the wall (27) of the spinning disk (16), configuring an opening (38) which, accordingly, is also circumscribed by a recess usually shaped in the form of a shell (39) for accumulation of the product's (P) dose, while through the bottom end of the dosing chamber tubular (37) Is completely sealed by a wall (40), which is centrally crossed by an integrated projection defined by two edges, one internal cylindrical on the top (41) and one external finned (42), the latter constituting a coupling for the actioning mechanism (19) of the piston (20), whereas the other (41) constitutes a coupling point for stabilizing a modified obturator (501), obtained from a suitable material substantially flexible in one sole piece which, in turn, is defined by three different parts, a bottom part with a springlike function (502), an intermediary part having the function of a piston (503) and a top part with the function of a tip (504).

The bottom part with a spring-like function (502) is formed by an ordinary tubular section, however, with a corrugated profile defined by ring sectors with different diameters and which mutually alternate and agree by rounding such that said tubular wall may have a wave-like profile with points inwards (505) and outwards (506), which mutually combine to allow compression and expansion of said top part as if it were a helicoidal spring.

The top part of tip (504) is a tronconic edge designed to penetrate the sealing (52), whose external diameter has a circular locking fillet (53) which penetrates into an equally circular groove (54) existing in the internal diameter of the dosing chamber (37) and next to the opening (38), where said insert is locked, and same is also equipped with a central tronconic hole (55) for the product outlet, however, normally closed by the edge of the sealing top (504) pressed permanently upwards by way of the spring (502).

Said intermediary part referred to as a piston (503) is defined by a retreated and rounded bottleneck (507), whose ends have as limits two sealing lips, a bottom one (508) and a top one (509), wherein the first is slightly inclined and interferingly slides along the internal diameter of the dosing chamber (37) and below the openings (57), while the other lip (509) in the shape of a tronconic collar like a cornet pavilion, having a height sufficient to circumscribe and osculate the outlet (55) of the insert (52), wherein Said outlet opening (55) is normally kept closed in a Seal-tight manner by the tip (504), however, this sealing occurs such that between Said constructive details an access area can form for the product (P) which arrives to the inner part of the valve (18) through radial passages (57) existing at the wall of the dosing chamber (37), where the pressure of the product (P) overcomes the spring pressure (502) and makes the sealing tip (504) be displaced downwards releasing the nozzle (55) enough for one dose of the product (P) to be deposited on the recess (39), returning to close the outlet nozzle (55) immediately after the internal pressure is compensated through the dosage release.

FIGS. 38 to 45 show constructive details of another preferred embodiment for the modified valve (600), maintaining the same drive in the form of a spinning disk (16), however, with significant modifications that begin in the dosing chamber ordinarily tubular (601) which, besides including side openings (602), is substantially reduced in height and has its end completely open and is integrated with the wall (27) of the spinning disk (16), configuring an opening (38) which, accordingly, is also circumscribed by a recess usually shaped in the form of a shell (39) for accumulation of the product's (P) dose, while through the bottom end the tubular dosing chamber (601) is completely closed by a wall (603), which is centrally crossed by an integrated projection defined by two edges, one internal in the form of fixed tip on the top (604) and one external finned on the bottom (605), the latter constitutes a coupling for the actioning mechanism (19) of the piston (20), while on the other (604), though a fixed tip, acts a substantially flexible obturator (606) and respective assembly ring (607), the latter with its external diameter having a circular fillet (608) for locking in the groove (54) of the actioning disk (16), where it is concentrically assembled, whereas the internal part of said assembly ring (607) is defined by two diameters, a smaller upper one (609) and a larger lower one (610), which mutually agree by way of a rounded corner (611), and this profile is defined by the two diameters and the intermediary step reflected in the external form of the flexible (606) which, accordingly, is shaped like an upturned cup, having an upper sealing wall (612) and a circular skirt (613), whose external parts, as already stated, define a geometry to lay perfectly against the internal profile of the ring (607) and, further, the skirt (613) has a height somewhat coinciding with the internal height of the chamber (601), where it also obstructs the openings (602) and, lastly, the wall (612) of said obturator has a central tronconic outlet hole (614), whose cone shape is appropriate for close-fitting and Seal-tight penetration of the fixed tip (604).

In this last constructive version the working of the obturator (606) equally depends on the pressure of the product (P), that is to say, when actioning the disk (16) the pressure created inside the packaging makes the product flow to the only outlet point defined by the openings (602) and, in this case, due to the flexibility of the obturator (606), the internal pressure causes temporary deformations therein, consequently, a small quantity of the product leaves by the interstices formed between the fixed parts of the valve and said flexible (606). This quantity of product accumulates in the part (39) as in the previous versions. Said interstices close immediately after compensation of the internal pressure with the release of the dosage.

It shall be understood that determined characteristics and combinations among the components that form the package may vary considerably, keeping always the same functional concept of a hermetic sealing and dosing mechanism for the set.

Consequently it is to be noted that the construction herein described in details as examples only, is clearly subject to constructive variations, although, always within the scope of the inventive concept disclosed herein.

The concept regards to a hermetic system which allows ejecting exact doses of the product within the inner portion of the package, and since a lot of modifications may be performed in the configuration herein detailed according to the descriptive demands of the law, it is understood that the present details shall be interpreted illustratively and not as a limitation.

The invention claimed is:

1. A packaging with a hermetically sealed dosing mechanism for semi-solid products comprising:

(1) a body, having:

(1a) a recess on the body of an upper surface;

(1b) a cup-like recipient, with a slightly oval internal diameter, having a bottom end and a top end; said cup-like recipient being internally concentric with said body, having an anti-vacuum opening, and containing a product;

(1c) an external skirt, having a bottom end and a top end;

(1d) a horizontal wall located at the top end of the cup-like recipient and the top end of the skirt;

(1e) two concentric internal collars emerging vertically from the horizontal wall defining a void between said two collars; the innermost of said two internal collars having a top edge having a circular closing ring and a cut inclined towards the interior of said void defined by said two collars; and the outermost of said two internal collars having an external diameter having a protruding circular ring, and a collar of equidistant teeth above the protruding ring spaced apart in groups by larger teeth; and a groove, below the protruding circular ring;

(2) an over-lid having a skirt with internal side having a continuous smooth coupling groove;

(3) a spinning disc, having a horizontal upper wall and a vertical cylindrical outer skirt, said cylindrical outer skirt having a bottom edge projected outwards in the shape of a flange with a diameter constructed and arranged to lay on said horizontal wall; and having smooth locking fillets, constructed and arranged to receive the over-lid; and having a concentric cylindrical lip in the shape of a circular guide, with a diameter that is constructed and arranged to penetrate with interference in the void and to be tensioned over the cut, said disc configured so that said bottom edge applies pressure on said circular closing ring, allowing an hermetic coupling of the spinning disc; and having a collar of flexible equidistant tabs, slightly bent and constructed and arranged to slide on a carriage formed by teeth, constructed and arranged to enable a sliding movement in only one direction; a collar of coupling projections with a trapezoidal transversal section dimensioned and oriented to be inserted in the groove so as to enable a sliding coupling for the spinning disc, in a way that said disc is kept permanently over pressured against the skirt, as well as being turned in only one direction, and in the same plane in relation to the skirt to secure sealing; and (4) an integrated internal assembly comprising an actioning mechanism, a piston placed along with the bottom of the cup-like recipient, and a protective dosing valve, wherein, the sliding movement actioning the mechanism actuates the piston, the spinning of said piston being avoided by the slightly oval internal diameter of the cup-like recipient; said piston being operatively assembled to be displaced only upwards upon activating the spinning disc and the mechanism, so that said piston applies sufficient pressure to the product placed above said piston in said cup-like recipient, opening the protective dosing valve and allowing exact dosages of the product to be dispensed above said spinning disc onto the surface, from where the product is removed by a user.

2. The packaging with a hermetically sealed dosing mechanism for semi-solid products according to claim 1, wherein the only direction of the spinning disc counter-clockwise.

3. The packaging with a hermetically sealed dosing mechanism for semi-solid products according to claim 1, wherein the dosing protection valve mechanism comprises a tubular dosing chamber having an upper section integrated with the horizontal upper wall, defining an opening circumscribed by the upper surface recess; for receiving the product; and having a lower end completely sealed by a wall, the wall having an external integrated lower finned projection constructed and arranged for coupling with the actioning mechanism and the piston; and the wall also having an internal integrated upper cylindrical projection constructed and arranged for coupling with a stabilizing obturator, said obturator formed in one sole piece having a bottom section with a spring formed by a tubular section with multiple cuts and an upper section comprising a sealing lid, having a cylindrical section which constitutes a top end of the spring, the cylindrical section having a collapsible sealing lip which slides with interference or tension at an internal diameter of the dosing chamber, the cylindrical section having an accentuated narrowing with a conic-shape above the sealing lip which ends in a conic pointy tip, which is oriented to penetrate in a sealing insert having an external diameter having a circular locking fillet which penetrates in a groove equally circular in the internal diameter of the dosing chamber and an opening where the insert is firmly locked; and having a conic central nozzle for releasing the product, close ip of the sealing lid, wherein, when the closed tip of the sealing lid is pressed upwards by the spring, the sealing lip and the sealing lid, define an access area for the product which arrives to the inner part of the protection valve through one or more radial passages in the wall of the dosing chamber, the pressure of the product overcoming the spring pressure and temporarily displacing the sealing tip downwards so as to sufficiently release the nozzle to allow one dose of the product to be deposited on the recess, and wherein the outlet orifice nozzle is closed immediately after the internal pressure is compensated through a dosage release.

4. The packaging with a hermetically sealed dosing mechanism for semi-solid products according to claim 1, wherein the activating mechanism has a screw-rod having an upper section having a short tubular section and an inner portion having radial fins, having additional fins between the radial fins, located under a center part of the spinning disc; said screw-rod constructed and arranged to penetrate the spinning disc in a manner that the screw-rod and the spinning disc are solitarily bonded; the screw-rod having a conic shape bottom section constructed and arranged to lay over an equally centered projection having a conic shape top section, which is circumscribed by a short tubular section emerging from an internal bottom wall in the internal part of the cup-like recipient; and the piston having a central hole with an internal screw elongated in a manner to be coupled between the conic shape top section and short tubular section, constructed and arranged to enable the piston to be displaced upwards, and the piston having radial bars in the internal diameter of the piston and sealing lips which remain permanently pressured against the internal diameter of the cup-like recipient ensuring the hermetic sealing in this point, wherein, when the screw-rod is positioned with some interference inside the internal screw of the piston, the hermetic sealing of the packaging is ensured with at least one complete turn of the screw while the packaging is not activated, and wherein with at least one or more complete turns of the screw the packaging is activated.

5. A reusable packaging with a hermetically sealed dosing mechanism for semi-solid products comprising:

(1) a body, having:

(1a) an upper surface;

(1b) a cup-like recipient, with a slightly oval internal diameter, having a bottom and a top end; internally concentrically to the body; containing a product;

(1c) an external skirt, having a bottom end and a top end;

(1d) a first collar emerging vertically from the top end of the cup-like recipient and having an outer section having a female coupling comprising channels with vertical inlet portions connected to short horizontal portions emerging vertically and a second collar emerging vertically from the top ending and having two protruding radial bolts oppositely placed from one another; the first collar and the second collar adjusted concentrically so as to provide a fast coupling and uncoupling means for coupling and uncoupling the top ending of the cup-like recipient and the top ending of the skirt, and said two collars defining a void; the first collar having a top edge having a circular closing ring and a cut inclined towards the interior of the void and the second collar having an external diameter having a protruding circular ring and equidistant teeth above the protruding ring spaced apart in groups by larger teeth; and a groove below the protruding circular ring;

(2) an over-lid having a skirt with an internal side having a continuous smooth coupling groove;

(3) a spinning disc, having a horizontal upper wall and a vertical cylindrical outside skirt, the cylindrical skirt having a flange-shaped bottom edge projected outwards with a diameter constructed and arranged to lay on the top end of the external skirt; and having smooth locking fillets, constructed and arranged to receive the over-lid; and having a concentric cylindrical lip in the shape of a circular guide, with a diameter constructed and arranged to penetrate with interference in the void and to be tensioned over the cut, and the bottom edge applying pressure on the circular closing ring or top nervure, allowing an hermetic coupling of the spinning disc; and having a collar of flexible equidistant tabs slightly bent and constructed and arranged to slide on a carriage formed by teeth, constructed and arranged to enable a sliding movement of the over-lid in only one direction; a collar of coupling projections with a trapezoidal transversal section dimensioned and oriented to be inserted in the groove, thus enabling a sliding coupling for the spinning disc in a way that said spinning disc is kept permanently over pressured against the skirt, as well as being turned in only one direction, and in the same plane in relation to the skirt to secure sealing;

(4) an integrated internal assembly comprising an actioning mechanism, a piston placed along with the bottom of the cup-like recipient, wherein, the sliding movement the over-lid actioning the mechanism, the mechanism actuating the piston, the spinning of the piston being avoided by the slightly oval internal diameter of the cup-like recipient; the piston operatively assembled to be displaced only upwards upon activating the spinning disc along with the mechanism, so that the piston applies enough pressure to the product placed above said piston, opening the protective dosing valve and allowing exact dosages of the product to be dispensed above said spinning disc and onto the surface, from where the product is removed by a user, and wherein, the vertical inlet portions connected to the short horizontal portions and the protruding radial bolts and cooperating for the penetration and reversible locking of the radial bolts, coupling and uncoupling the cup-like refill recipient from the skirt, enabling the cup-like refill recipient to be removed and discarded when empty and substituted; and wherein the cup-like refill recipient when full is coupled in the inner portion of the cover and integrated lower finned projection and penetrates the short tubular section of screw-rod already assembled to the piston inside the cup-like recipient and consequently, the packaging is ready to be reused and the hermetic sealing of the packaging is maintained when coupled.

6. The packaging with a hermetically sealed dosing mechanism for semi-solid products according to claim 5, wherein the cup-like recipient is temporarily sealed by a removable seal, wherein the removal occurs manually prior to the coupling of the refill.

7. A packaging with a hermetically sealed dosing mechanism for semi-solid products comprising:

(1) a body, having:

(1a) an upper surface recess;

(1b) a cup-like recipient, with a slightly oval internal diameter, having a bottom, a top end and a top wall; the recipient internally concentrically to the body; containing a product;

(1c) a cover, having a bottom end and a top end; the top end of the cover integrated to the top end of the cup-like recipient, by an external diameter reduction emerging vertically from the top end of the cup-like recipient and of the top end of the cover (2) an over-lid having a skirt with an internal side having a continuous coupling section with the external diameter reduction; with the diameter constructed and arranged to lay on the top end of the external skirt;

(3) an integrated internal assembly comprising a protective dosing valve, connected to the top wall, an actioning mechanism, coupled with a piston, the actioning mechanism having a screw-rod having an upper end spin-coupled by male-female coupling defined by a rounded bottom tip which develops vertically down from a dosing chamber and the protection dosing valve, the bottom tip penetrates a cavity existing at the upper end of the screw-rod, and having a bottom end integrated in a whole piece with a spinning base, having the shape of a spinning disc, having a back wall and a circular skirt which is coupled in a rotational form towards the external diameter of a bottom end of the cover, where the rotation of the spinning base is equally accomplished step by step and always in the same plane in relation to the body, and having a collar of flexible equidistant tabs, slightly bent and constructed and arranged to slide on a carriage formed by teeth, constructed and arranged to enable a sliding movement the cover in only one direction; a collar of coupling projections with a trapezoidal transversal section dimensioned and oriented to be inserted in the groove enabling a sliding coupling for the circular skirt, in a way that said coupling is kept permanently pressured against the skirt, as well as being turned in only one direction, and in the same plane in relation to the skirt to secure sealing.

8. A packaging with a hermetically sealed dosing mechanism for semi-solid products comprising:

(1) a body, having;

(1a) an upper surface recess;

(1b) a cup-like recipient, with a slightly oval internal diameter, having a bottom and a top end; internally concentrically to the body; having an anti-vacuum opening, and containing a product;

(1c) an external skirt, having a bottom and top end;

(1e) two concentric internal collars emerging vertically from the cup-like recipient and the cover or skirt, the collars integrated at the top end and forming a top joint; the top joint defining a V-shape groove configured on an upper section of the top joint, said concentric collars having an upper section having an integrated projection that configures a sealing ring;

(2) an over-lid having a skirt with an internal side having a continuous smooth coupling groove;

(3) a spinning disc having a horizontal upper wall and a vertical cylindrical outside skirt, the cylindrical skirt having a flange-shaped bottom edge projected outwards with a diameter constructed and arranged to lay on the top end of said external skirt; and having smooth locking fillets, constructed and arranged to receive the over-lid; a bottom surface of the spinning disc, having a concentric cylindrical lip of reduced height, in the shape of a circular guide and having a diameter larger than the diameter of said V-shape groove, constructed and arranged to fit in said V-shape groove, the larger diameter being slightly bent and applying pressure against said collar, allowing an hermetic coupling of the spinning disc; and having a collar of flexible equidistant tabs, slightly bent and constructed and arranged to slide on a carriage formed by teeth, constructed and arranged to enable a sliding movement of the over-lid in only one direction; a collar of coupling projections with a trapezoidal transversal section dimensioned and oriented to be inserted in the groove thus enabling a sliding coupling for the spinning disc, in a way that said spinning disc is kept permanently over pressured against the skirt, as well as being turned in only one direction, and in the same plane in relation to the skirt to secure sealing; and (4) an integrated internal assembly comprising an actioning mechanism, a piston placed along the bottom of the cup-like recipient, and a protective closing valve, wherein, the sliding movement of the over-lid actuates the mechanism, the mechanism actuates the piston, the spinning of said piston being avoided by the slightly oval internal diameter of the cup-like recipient; the piston operatively assembled to be displaced only upwards upon activating the spinning disc and the mechanism, so that the piston applies sufficient pressure to the product placed above said piston, opening the protective dosing valve and allowing exact dosages of the product to be dispensed above said spinning disc onto the surface, from where the product is removed by a user.

9. A packaging with a hermetically sealed dosing mechanism for semi-solid products comprising:

(1) a body, having:

(1a) an upper surface;

(1b) a cup-like recipient, with a slightly oval internal diameter, having a bottom and a top end; internally concentrically to the body; containing a product;

(1c) an external skirt, having a bottom and top end;

(1d) a first collar emerging vertically from the top end of the cup-like recipient and having an outer section having a female coupling comprising channels with vertical inlet portions connected to short horizontal portions emerging vertically therefrom and a second collar emerging vertically from the top end and having two protruding radial bolts oppositely placed from one another; the first collar and the second collar adjusted concentrically providing for a fast coupling and uncoupling means for coupling and uncoupling the top end of the cup-like recipient and the top end of the skirt, said collars defining a groove in the shape of a "V" and the sealing ring, both configured on the top end of the wall of the cup-like recipient, in which an external diameter is coupled with the wall of the finishing cover or skirt, (2) an over-lid having a skirt with an internal side having a continuous smooth coupling groove;

(3) a spinning disc, having a horizontal upper wall and a vertical cylindrical outside skirt, said cylindrical skirt having a flange-shaped bottom edge projecting outwards with a diameter constructed and arranged to lay on the top end of the external skirt; and having smooth locking fillets, constructed and arranged to receive the over-lid; and having a concentric cylindrical lip in the shape of a circular guide with a diameter is constructed and arranged to penetrate with interference in the groove in the shape of a "V", allowing an hermetic coupling of the spinning disc; and having a collar of flexible equidistant tabs, slightly bent and constructed and arranged to slide on a carriage formed by teeth, constructed and arranged to enable a sliding movement of the over-lid in only one direction; a collar of coupling projections with a trapezoidal transversal section dimensioned and oriented to be inserted in the groove enabling a sliding coupling for the spinning disc so that said spinning disc is kept permanently pressured against the skirt, as well as being turned in only one direction, and in the same plane in relation to the skirt to secure sealing; the top of the wall of the cup-like recipient including another ring projection which configures a coupling without male interference which penetrates in the female coupling existing in the bottom face of the spinning disc; and (4) an integrated internal assembly comprising a an actioning mechanism, piston placed along with the bottom of the cup-like recipient, wherein, the sliding movement of the over-lid actioning the mechanism, the mechanism actuating the piston, the spinning of said piston being avoided by the slightly oval internal diameter of the cup-like recipient; the piston operatively assembled to be displaced only upwards upon activating the spinning disc and the mechanism so that said piston applies sufficient pressure to the product placed above said piston, opening the protective dosing valve and allowing exact dosages of the product to be dispensed above said spinning disc onto the surface, from where the product is removed by a user, and wherein, the vertical inlet portions connected to the short horizontal portions and the protruding radial bolts cooperate for the penetration and reversible locking of the radial bolts, coupling and uncoupling the cup-like refill recipient from the skirt, enabling the cup-like refill recipient to be removed and discarded when empty and substituted; the cup-like refill recipient when full is coupled in the inner portion of the cover and integrated lower finned projection penetrates the short tubular section of a screw-rod already assembled to the piston inside the cup-like recipient and consequently, the packaging is ready to be reused and the hermetic sealing of the packaging is maintained when coupled.

10. A packaging with a hermetically sealed dosing mechanism for semi-solid products comprising:

(1) a body, having:

(1a) an upper surface recess;

(1b) a cup-like recipient, with a slightly oval internal diameter, having a bottom and a top end; internally concentrically to the body; having an anti-vacuum opening, and containing a product;

(1c) an external skirt, having a bottom and top end;

(1d) a horizontal wall integrating the top end of the cup-like recipient and the top end of the skirt;

(1e) two concentric internal collars emerging vertically from the horizontal wall defining a void; the innermost of said collars having a top edge having a circular closing ring and a cut inclined towards the interior of the void; and the outermost of said collars having an external diameter having a protruding circular ring, and a collar of equidistant teeth above the protruding ring spaced apart in groups by larger teeth; and a groove below the protruding circular ring;

(2) an over-lid having a skirt with internal side having a continuous smooth coupling groove;

(3) a spinning disc, having a horizontal upper wall and a vertical cylindrical outside skirt, the cylindrical skirt having a flange-shaped bottom edge projecting outwards with a diameter constructed and arranged to lay on horizontal wall; and having smooth locking fillets, constructed and arranged to receive the over-lid; and having a concentric cylindrical lip in the shape of a circular guide with a diameter constructed and arranged to penetrate with interference in the void and to be tensioned over the cut, and the bottom edge applying pressure on the circular closing ring, allowing an hermetic coupling of the spinning disc; and having a collar of flexible equidistant tabs, slightly bent and constructed and arranged to slide on a carriage formed by teeth, constructed and arranged to enable a sliding movement the over-lid in only one direction; a collar of coupling projections with a trapezoidal transversal section dimensioned and oriented to be inserted in the groove enabling a sliding coupling for the spinning disc, in a way that the spinning disc is kept permanently pressured against the skirt, as well as being turned in only one direction, and in the same plane in relation to the skirt to secure sealing; and (4) an integrated internal assembly comprising an actioning mechanism, including a tubular dosing chamber, the chamber having an upper end open, and integrated with a wall of the spinning disc, configuring an opening, the opening circumscribed by a surface enabling an accumulation of the product, and the chamber having a lower end completely sealed by a wall, which is centrally crossed by an integrated projection defined by a first and a second edge, the first edge being an internal cylindrical edge on the upper end and the second edge being an external finned edge, the external finned edge constituting a coupling for the actioning mechanism of a piston, and the internal cylindrical edge constituting a coupling point for stabilizing a modified obturator, obtained from a suitable material substantially flexible in one sole piece defined by a bottom part with a spring, an intermediary part functioning as a piston and a top part function as a tip; said bottom part with the spring formed by an ordinarily tubular section with a corrugated profile defined by ring sectors with different diameters mutually alternating and agreeing by rounding such that said tubular wall have a wave-like profile with inward points and outward points, which mutually combine to allow compression and expansion of said part as an helicoidal spring; wherein said tip is a tronconic edge designed to penetrate the sealing insert, the external diameter having a circular locking fillet which penetrates into an equally circular groove in the internal diameter of the dosing chamber and next to an opening, where said insert is locked, and having a central tronconic hole for the product outlet, in a closed position by an edge of the sealing tip pressed permanently upwards by way of the spring; said piston defined by a retreated and rounded bottleneck, the pistons having a bottom end and an upper end actuating as two sealing lips, the bottom end being slightly inclined and interferingly slided along the internal diameter of the dosing chamber and below an openings, and the upper end in the shape of a tronconic collar, having a height sufficient to circumscribe and osculate an outlet opening of the sealing insert, wherein said outlet opening is normally kept closed in a seal-tight manner by the tip, wherein the sealing occurs such that the product arrives to an inner part of the valve through the openings at the wall of the dosing chamber, where the pressure of the product overcomes the spring pressure displacing the sealing tip downwards releasing the outlet opening and allowing exact dosages of the product to be dispensed above the said spinning disc onto the surface, from where the product is removed by a user; returning to close the opening immediately after the internal pressure is compensated through a dosage release.

11. A packaging with a hermetically sealed dosing mechanism for semi-solid products comprising:

(1) a body, having:

(1a) an upper surface recess;

(1b) a cup-like recipient, with a slightly oval internal diameter, having a bottom and a top end; internally concentrically to the body; having a anti-vacuum opening, and containing a product;

(1c) an external skirt, having a bottom and a top end;

(1d) a horizontal wall integrating the top end of the cup-like recipient and the top end of the skirt;

(1e) two concentric internal collars emerging vertically from the horizontal wall defining a void; the innermost of said collars having a top edge having a circular closing ring and a cut inclined towards the interior of the void; and the outermost of said collars having an external diameter having a protruding circular ring, and a collar of equidistant teeth above the protruding ring spaced apart in groups by larger teeth; and a groove, below the protruding circular ring;

(2) an over-lid having a skirt with internal side having a continuous smooth coupling groove;

(3) a spinning disc, having a horizontal upper wall and a vertical cylindrical outside skirt, the cylindrical skirt having a flange-shaped bottom edge projecting outwards with a diameter constructed and arranged to lay on the horizontal wall; and having smooth locking fillets, constructed and arranged to receive the over-lid; and having a concentric cylindrical lip in the shape of a circular guide with a diameter constructed and arranged to penetrate with interference in the void and to be tensioned over the cut, and the bottom edge applying pressure on the circular closing ring or a top rib on said closing ring, allowing an hermetic coupling of the spinning disc; and having a collar of flexible equidistant tabs, slightly bent and constructed and arranged to slide on a carriage formed by teeth, constructed and arranged to enable a sliding movement of the over-lid in only one direction; a collar of coupling projections with a trapezoidal transversal section dimensioned and oriented to be inserted in the groove to enable a sliding coupling for the spinning disc, in a way that said spinning disc is kept permanently pressured against the skirt, as well as being turned in only one direction, and in the same plane in relation to the skirt to secure sealing; and (4) an integrated internal assembly comprising an actioning mechanism, including a modified valve, having a tubular dosing chamber having side openings, substantially reduced in height and having an upper end open and integrated with a wall of the spinning disk, configuring an opening which is circumscribed by a surface enabling an accumulation of the product, and the chamber having a lower end completely sealed by a wall, which is centrally crossed by an integrated projection defined by first and a second edge, the first edge being an internal cylindrical edge on the upper end and the second edge being an external finned edge, the external finned edge constituting a coupling for the actioning mechanism of a piston, and the internal cylindrical edge constituting a coupling point for stabilizing a modified obturator and respective assembly ring with an external diameter having a circular fillet for locking in a groove of the spinning disk, which is concentrically assembled; and with a smaller upper internal diameter upper one and a larger lower diameter, mutually agreeing by way of a rounded corner with a flexible obturator of a upturned cup shape, having an upper sealing wall and a circular skirt, whose external parts define a geometry to lay against an internal profile of the ring and, the skirt having a height coinciding with an internal height of the chamber, obstructing said side openings and; the wall having a cone-shape central tronconic outlet hole, appropriate for close-fitting and seal-tight penetration of a fixed tip.

* * * * *